US009208631B2

(12) United States Patent
Ito et al.

(10) Patent No.: US 9,208,631 B2
(45) Date of Patent: Dec. 8, 2015

(54) BANKNOTE BUNDLING DEVICE, BANKNOTE BUNDLING METHOD, AND BANKNOTE BUNDLING SYSTEM

(75) Inventors: Osamu Ito, Hyogo (JP); Hiroshi Nobuhara, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 245 days.

(21) Appl. No.: 13/255,619

(22) PCT Filed: Mar. 10, 2009

(86) PCT No.: PCT/JP2009/054560

§ 371 (c)(1),
(2), (4) Date: Sep. 9, 2011

(87) PCT Pub. No.: WO2010/103620

PCT Pub. Date: Sep. 16, 2010

(65) Prior Publication Data

US 2011/0315760 A1 Dec. 29, 2011

(51) Int. Cl.

| | |
|---|---|
| ***G07F 19/00*** | (2006.01) |
| ***G07D 11/00*** | (2006.01) |
| *B65B 27/08* | (2006.01) |

(52) U.S. Cl.

CPC ..... *G07D 11/0021* (2013.01); *B65B 27/08* (2013.01)

(58) Field of Classification Search

CPC ..... G07F 19/00; G06Q 40/02; G07D 11/00

USPC ..... 235/375, 379, 380

See application file for complete search history.

(56) References Cited

U.S. PATENT DOCUMENTS

| | | | | |
|---|---|---|---|---|
| 6,019,210 | A * | 2/2000 | Matsunaga et al. | 194/206 |
| 7,699,152 | B2 * | 4/2010 | Kanno et al. | 194/206 |
| 2005/0206710 | A1 | 9/2005 | Otsuka | |

FOREIGN PATENT DOCUMENTS

| | | |
|---|---|---|
| JP | 06-219419 | 8/1994 |
| JP | 2003-237726 | 8/2003 |
| JP | 2003-346212 | 12/2003 |
| JP | 2007-122120 | 5/2007 |

* cited by examiner

*Primary Examiner* — Daniel St Cyr

(74) *Attorney, Agent, or Firm* — Renner, Kenner, Greive, Bobak, Taylor & Weber

(57) ABSTRACT

A banknote bundling device (3) makes a bundle of banknotes by bundling with a bundling tape one-hundred bundling-object-banknotes of a specific kind from among a plurality of banknotes. The banknote bundling device (3) includes a serial-number identification unit (16) that acquires a serial number for identify the banknote for each banknote, a bundle-ID creating unit (183) that creates a bundle ID associated with the serial number of each banknote of the bundle of banknotes for each bundle of banknotes, and a print control unit (184) that controls a printer (55) to print the bundle ID created by the bundle-ID creating unit (183) on the bundling tape of the bundle of banknotes for each bundle of banknotes. Therefore, a financial institution can adequately handle a false claim regarding a valid bundle of banknotes.

12 Claims, 8 Drawing Sheets

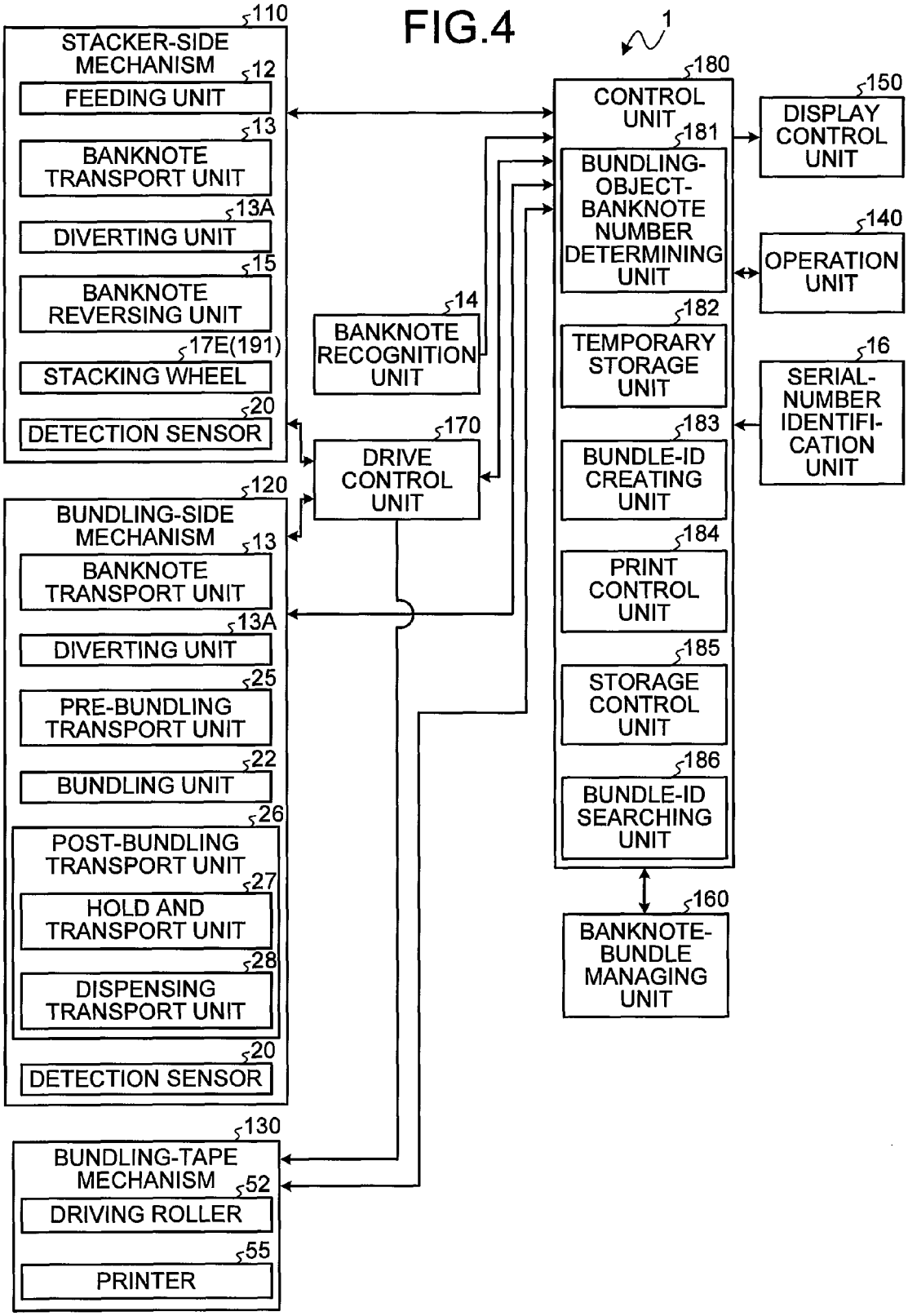
FIG.4
1
110
STACKER-SIDE MECHANISM
12
FEEDING UNIT
13
BANKNOTE TRANSPORT UNIT
13A
DIVERTING UNIT
15
BANKNOTE REVERSING UNIT
17E(191)
STACKING WHEEL
20
DETECTION SENSOR
14
BANKNOTE RECOGNITION UNIT
170
DRIVE CONTROL UNIT
120
BUNDLING-SIDE MECHANISM
13
BANKNOTE TRANSPORT UNIT
13A
DIVERTING UNIT
25
PRE-BUNDLING TRANSPORT UNIT
22
BUNDLING UNIT
26
POST-BUNDLING TRANSPORT UNIT
27
HOLD AND TRANSPORT UNIT
28
DISPENSING TRANSPORT UNIT
20
DETECTION SENSOR
130
BUNDLING-TAPE MECHANISM
52
DRIVING ROLLER
55
PRINTER
180
CONTROL UNIT
181
BUNDLING-OBJECT-BANKNOTE NUMBER DETERMINING UNIT
182
TEMPORARY STORAGE UNIT
183
BUNDLE-ID CREATING UNIT
184
PRINT CONTROL UNIT
185
STORAGE CONTROL UNIT
186
BUNDLE-ID SEARCHING UNIT
150
DISPLAY CONTROL UNIT
140
OPERATION UNIT
16
SERIAL-NUMBER IDENTIFI-CATION UNIT
160
BANKNOTE-BUNDLE MANAGING UNIT

160

| 160A BUNDLE ID | 160B SERIAL NUMBER |
|---|---|
| 000001 | A23456789 ⋮ |
| 000002 | H35678901 ⋮ |
| | |
| ⋮ | ⋮ |

22A
P
42
27A

22A
P
42
27A

22A
P
42
27A

22A
P
42
27A

22A
P1
R
27A

22A
P1
R
27A

22A
P1
R
27A

BANKNOTE BUNDLING DEVICE, BANKNOTE BUNDLING METHOD, AND BANKNOTE BUNDLING SYSTEM

TECHNICAL FIELD

The present invention relates to a banknote bundling device, a banknote bundling method, and a banknote bundling system that are used for making a bundle of banknotes by bundling, for example, a certain kind of banknotes in units of a predetermined number of banknotes.

BACKGROUND ART

Conventionally, a banknote bundling device known to the inventor includes a bundling unit and a printing unit (for example, see Patent Document 1). The bundling unit makes a bundle of banknotes by bundling a predetermined number of a certain kind of bundling-object-banknotes with a bundling tape. The printing unit prints a sequence number for each bundling operation on the bundling tape. Moreover, if the bundling operation is not performed and loose banknotes remain in the apparatus, the printing unit prints the same sequence number on the bundling tape with which the loose banknotes are next bundled.

Because the banknote bundling device disclosed in Patent Document 1 prints the sequence number on the bundling tape of the bundle of banknotes, it is easier to handle the remaining loose banknotes in the apparatus in case a failure occurred. The banknote bundling device assigns a sequence number to be printed at the time of the occurrence of the failure to the first bundle of banknotes after the bundling process is restarted. Consequently, it is possible to reduce a count error caused by the occurrence of the failure and an error that an operator may make when recalculating remaining banknotes.

As a technique for performing printing on the bundling tape of the bundle of banknotes, the inventor knows, for example, a technique for printing a serial number of the first banknote on a bundling tape with which, for example, new bills having consecutive serial numbers are bundled (for example, see Patent Documents 2 and 3).

In the technique disclosed in Patent Document 3, for example, a serial number card, on which serial numbers to be printed on marketable securities of a bundle of 1000 marketable securities are printed, and serial numbers actually printed on the marketable securities of the bundle of 1000 marketable securities are compared and the quality of the 1000 marketable securities bundle is confirmed based on the comparison result.

Recently, there has been a proliferation of counterfeit banknotes, and there are instances of overseas counterfeit banknotes dispensed from automatic teller machines (herein after, "ATM") of financial institutions, resulting in damage of credibility for some financial institutions.

Furthermore, there have been instances of misuse of such circumstances by some who make false claims that the bundle of banknotes dispensed by the financial institution includes counterfeit notes, or that the number of banknotes in the bundle is falling short of the desired number even when the bundle is valid and all the banknotes in the bundle are genuine. Therefore, there has been a need for countermeasures against such situations.

Patent Document 1: Japanese Patent Application Laid-open No. H6-219419

Patent Document 2: Japanese Patent Application Laid-open No. 2003-237726

Patent Document 3: Japanese Patent Application Laid-open No. 2003-346212

DISCLOSURE OF INVENTION

Problem to be Solved by the Invention

However, even if the conventional techniques disclosed in the Patent Documents 1 to 3 are employed, it is a fact that at the present time the financial institutions cannot adequately handle false claims made against bundles of genuine banknotes.

The present invention has been made in view of the above problems, and an object of the invention is to provide a banknote bundling device, a banknote bundling method, and a banknote bundling system that can be used for handling the false claim made against valid bundles of genuine banknotes adequately and protecting the credibility of financial institutions.

Means for Solving Problem

To achieve the above object, according to an aspect of the present invention, a banknote bundling device, that makes a bundle of banknotes by bundling with a bundling tape a predetermined number of bundling-object-banknotes of a specific kind among a plurality of deposited banknotes, includes a specific information acquiring unit that acquires, for each banknote, banknote-specific information for distinguishing the banknote; a related information creating unit that creates, for each bundle of banknotes, related information associated with the banknote-specific information for each banknote of the bundle of banknotes; and a related information assigning unit that assigns, for each bundle of banknotes, the related information created by the related information creating unit to the bundling tape of the bundle of banknotes.

According to another aspect of the present invention, the banknote bundling device further includes an information storage managing unit that stores therein and manages the banknote-specific information for each banknote of the bundle of banknotes in an associated form with the related information of the bundle of banknotes.

According to still another aspect of the present invention, the banknote bundling device further includes an information searching unit that, in response to an input operation for inputting the related information assigned to the bundling tape, searches the information storage managing unit for the banknote-specific information of each banknote of the bundle of banknotes associated with the related information inputted in the input operation; and an information output unit that outputs the banknote-specific information of each banknote of the bundle of banknotes that is a search result of the information searching unit.

According to still another aspect of the present invention, the banknote bundling device further includes an information searching unit that, in response to a reading operation for reading the related information assigned to the bundling tape, searches the information storage managing unit for the banknote-specific information for each banknote of the bundle of banknotes corresponding to the related information obtained by the reading operation; and an information output unit that outputs the banknote-specific information for each banknote of the bundle of banknotes that is a search result of the information searching unit.

According to still another aspect of the present invention, in the banknote bundling device, the banknote-specific information is serial number information that is printed on the banknote.

According to still another aspect of the present invention, in the banknote bundling device, the banknote-specific information is an image of at least one face out of a front face and a back face of the banknote.

According to still another aspect of the present invention, in the banknote bundling device, the related information is bundle identification information for distinguishing the bundle of banknotes.

According to still another aspect of the present invention, in the banknote bundling device, the related information is banknote-specific information of all the banknotes of the bundle of banknotes.

According to still another aspect of the present invention, the banknote bundling device further includes an information output unit that outputs, in response to a reading operation for reading the related information assigned to the bundling tape, the banknote-specific information for each banknote of the related information obtained by the reading operation.

According to still another aspect of the present invention, in the banknote bundling device, the related information is serial number information printed on each banknote of the bundle of banknotes.

According to still another aspect of the present invention, in the banknote bundling device, the specific kind is a genuine note of a specific denomination.

To achieve the above object, according to still another aspect of the present invention, a banknote bundling method for making a bundle of banknotes by bundling with a bundling tape a predetermined number of bundling-object-banknotes of a specific kind among a plurality of deposited banknotes includes acquiring, for each banknote, banknote-specific information for distinguishing the banknote; creating, for each bundle of banknotes, related information associated with the banknote-specific information for each banknote of the bundle of banknotes; and assigning, for each bundle of banknotes, the related information created at the creating to the bundling tape of the bundle of banknotes.

According to still another aspect of the present invention, the banknote bundling method further includes storing and managing the banknote-specific information for each banknote of the bundle of banknotes in an associated form with the related information of the bundle of banknotes in an information storage managing unit.

According to still another aspect of the present invention, the banknote bundling method further includes searching, in response to an input operation for inputting the related information assigned to the bundling tape, the information storage managing unit for the banknote-specific information for each banknote of the bundle of banknotes associated with the related information inputted in the input operation; and outputting the banknote-specific information of each banknote of the bundle of banknotes that is a search result at the searching.

To achieve the above object, according to still another aspect of the present invention, a banknote bundling system includes a banknote bundling device that makes a bundle of banknotes by bundling, with a bundling tape, a predetermined number of bundling-object-banknotes of a specific kind among a plurality of deposited banknotes; and an information managing device that manages information associated with the bundle of banknotes. The information managing device includes a specific information acquiring unit that acquires, for each banknote, banknote-specific information for distinguishing the banknote; and a related information creating unit that creates, for each bundle of banknotes, related information associated with the banknote-specific information for each banknote of the bundle of banknotes. The banknote bundling device includes a related information assigning unit that assigns, for each bundle of banknotes, the related information created by the related information creating unit to the bundling tape of the bundle of banknotes.

According to still another aspect of the present invention, in the banknote bundling system, the information managing device further includes an information storage managing unit that stores therein and manages the banknote-specific information for each banknote of the bundle of banknotes in an associated form with the related information of the bundle of banknotes.

According to still another aspect of the present invention, in the banknote bundling system, the information managing device further includes an information searching unit that, upon detecting an information inquiry request regarding the related information assigned to the bundling tape from a terminal device that is connected to the information managing device for communication, searches the information storage managing unit for the banknote-specific information for each banknote of the bundle of banknotes associated with the related information; and an information output unit that outputs to the terminal device the banknote-specific information of each banknote of the bundle of banknotes that is a search result of the information searching unit.

Advantages of the Invention

With this structure, a banknote bundling device according to the present invention acquires banknote-specific information of each banknote of a bundle of banknotes, creates, for each bundle, related information associated with the banknote-specific information of each banknote of the bundle, and further assigns, for each bundle of banknotes, the related information to a bundling tape of the bundle of banknotes. Thus, even if a false claim is made regarding a valid bundle of banknotes dispensed by a financial institution deploying the banknote bundling device, there is an advantage in that because the banknote-specific information of each banknote of the bundle can be obtained from the related information printed on the bundling tape due to their association, the financial institution can adequately protect its own credibility through comparison and checking operation based on the banknote-specific information.

The banknote bundling device according to the present invention stores therein and manages the banknote-specific information of each banknote of the bundle in an associated form with the related information of the bundle of banknotes. Thus, there is an advantage in addition to the above advantage in that the financial institution can obtain the banknote-specific information for each banknote of the valid bundle of banknotes dispensed by itself and thus can adequately handle a false claim.

The banknote bundling device according to the present invention searches, in response to an input operation of the related information assigned to the bundling tape as a target for searching, the information storage managing unit for banknote-specific information for each banknote of the bundle corresponding to the inputted related information, and outputs the banknote-specific information of each banknote of the bundle as a search result. Thus, even if a false claim is made by a customer regarding the valid bundle of banknotes dispensed by the financial institution, there is an advantage in addition to the above advantages in that by requesting the customer to submit the related information assigned to the bundling tape, and inputting the submitted related information, the banknote-specific information of each banknote of the bundle of banknotes dispensed by the financial institution can be displayed on a display screen. Therefore, the financial institution can adequately handle the false claim by comparison and checking operation based on the banknote-specific information.

The banknote bundling device according to the present invention searches banknote-specific information for each banknote of the bundle corresponding to the related information obtained from the information storage managing unit by a reading operation of the related information assigned to the bundling tape, and outputs the banknote-specific information for each banknote of the bundle as the search result. Consequently, even if a false claim is made by a customer regarding the valid bundle of banknotes dispensed by the financial institution, there is an advantage in addition to the above advantages in that by requesting the customer to submit the related information assigned to the bundling tape, and reading the submitted related information, the banknote-specific information of each banknote of the bundle of banknotes dispensed by the financial institution can be displayed on a display screen. Therefore, the financial institution can adequately handle the false claim by comparison and checking operation based on the banknote-specific information.

The banknote-specific information of the banknote bundling device according to the present invention can be serial number information printed on a banknote. Thus, even if a false claim is made regarding the valid bundle of banknotes dispensed by the financial institution, there is an advantage in addition to the above advantages in that the financial institution can obtain the serial number information of all the banknotes of the bundle of banknotes dispensed by the financial institution and thus can adequately handle the false claim by a comparison and checking operation based on the banknote-specific information.

The banknote-specific information of the banknote bundling device according to the present invention can be an image of at least one face, a front face or a back face of the banknote. Thus, even if a false claim is made regarding the valid bundle of banknotes dispensed by the financial institution, there is an advantage in addition to the above advantages in that the financial institution can obtain the serial numbers and a states of the banknotes, such as soiling and staining, of the valid bundle dispensed by the financial institution based on the banknote images. Consequently, the financial institution can adequately handle the false claim.

The related information of the banknote bundling device according to the present invention can be bundle identification information for distinguishing the bundle of banknotes. Therefore, there is an advantage in addition to the above advantages that the financial institution can obtain the banknote-specific information of all the banknotes of the bundle associated with the bundle identification information.

The related information of the banknote bundling device according to the present invention can be banknote-specific information of each banknote of the bundle of banknotes. Therefore, there is an advantage in addition to the above advantages that the financial institution can obtain the banknote-specific information of all the banknotes of the bundle of banknotes.

The banknote bundling device according to the present invention outputs the banknote-specific information of each banknote associated with the related information obtained by the reading operation of related information assigned to the bundling tape. Thus, even if a false claim is made by a customer regarding the valid bundle of banknotes dispensed by the financial institution, there is an advantage in addition to the above advantages in that by requesting the customer to submit the related information assigned to the bundling tape, and reading the submitted related information, the banknote-specific information of each banknote of the bundle of banknotes dispensed by the financial institution can be displayed on a display screen. Therefore, the financial institution can adequately handle the false claim by comparison and checking operation based on the banknote-specific information.

The related information of the banknote bundling device according to the present invention can be the serial number information printed on each banknote of the bundle of banknotes. Thus, there is an advantage in addition to the above advantages that the financial institution can obtain the serial number information for each banknote of the valid bundle of banknotes dispensed by the financial institution by using the related information on the bundling tape without having to perform a search operation.

The banknote bundling device according to the present invention processes genuine notes of a specific kind, as the bundling-object-banknotes, from among a plurality of banknotes. Therefore, there is an advantage in addition to the above advantages in that, in addition to unequivocally preventing any error concerning the number of banknotes in a bundle by bundling a predetermined number of bundling-object-banknotes, any mixture of counterfeit notes in the bundle can be prevented by processing genuine notes of a specific kind as the bundling-object-banknotes.

In a banknote bundling method according to the present invention, banknote-specific information for each banknote of a bundle is acquired, related information associated with the banknote-specific information for each banknote of the bundle is created for each of the bundle, and further, the related information is assigned to a bundling tape of the bundle for each of the bundle of banknotes. Therefore, even if a false claim is made regarding a valid bundle of banknotes dispensed by a financial institution deploying the banknote bundling device, there is an advantage in that because the banknote-specific information of each banknote of the bundle can be obtained from the related information assigned to the bundling tape by virtue of their association, the financial institution can adequately protect its own credibility through comparison and checking operation based on the banknote-specific information.

In the banknote bundling method according to the present invention, the banknote-specific information of each banknote of a bundle is stored and managed in association with the related information of the bundle of banknotes. Therefore, there is an advantage in addition to the above advantage in that the financial institution can obtain the banknote-specific information for each banknote of the valid bundle of banknotes dispensed by the financial institution. Consequently, the financial institution can adequately respond to a false claim.

In the banknote bundling method according to the present invention, in response to an input operation for searching for the related information assigned to the bundling tape, the information storage managing unit is searched for the banknote-specific information of each banknote of a bundle, and the banknote-specific information for each banknote of the bundle is output as a search result. Therefore, even if a false claim is made by a customer regarding the valid bundle of banknotes dispensed by the financial institution, there is an advantage in addition to the above advantages in that, by requesting the customer to submit the related information assigned to the bundling tape and inputting the submitted related information, the banknote-specific information of each banknote of the bundle dispensed by itself can be displayed on a display screen. Therefore, the financial institution can adequately handle the false claim by comparison and checking based on the banknote-specific information.

In a banknote bundling system according to the present invention, banknote-specific information of each banknote of a bundle is acquired and related information associated with the banknote-specific information of each banknote of the bundle is created for each bundle through an information managing device, and the related information is assigned to the bundling tape of the bundle for each bundle through a banknote bundling device. Therefore, even if a false claim is made regarding a valid bundle of banknotes dispensed by a financial institution deploying the banknote bundling device, there is an advantage in that because the banknote-specific information of each banknotes of the bundle can be obtained based on the related information printed on the bundling tape by virtue of their association, the financial institution can adequately protect its own credibility through comparison and checking operation based on the banknote-specific information.

In the banknote bundling system according to the present invention, the banknote-specific information for each banknote of the bundle are stored and managed in association with the related information for the bundle of banknotes. Therefore, there is an advantage in addition to the above advantage in that the financial institution can obtain the banknote-specific information for each banknote of the valid bundle of banknotes dispensed by itself and thus can adequately respond to a false claim.

In the banknote bundling system according to the present invention, the information managing device, when detecting an information inquiry request regarding the related information assigned to the bundling tape from a terminal device that is connected to the information managing device, searches the information memory managing unit for the banknote-specific information for each banknote of the bundle of banknotes associated with the related information and outputs to the terminal device the banknote-specific information of each banknote of the bundle of banknotes as a search result. Therefore, even if the terminal device is at a remote location, the banknote-specific information of all the banknote of the bundle of banknotes can be displayed at the remote location, a false claim can be handled by comparison and checking operation based on the banknote-specific information.

BRIEF DESCRIPTION OF DRAWINGS

FIG. 4 is a schematic block diagram of an internal structure of the banknote sorting and bundling apparatus.

EXPLANATIONS OF LETTERS OR NUMERALS

Figure 1:
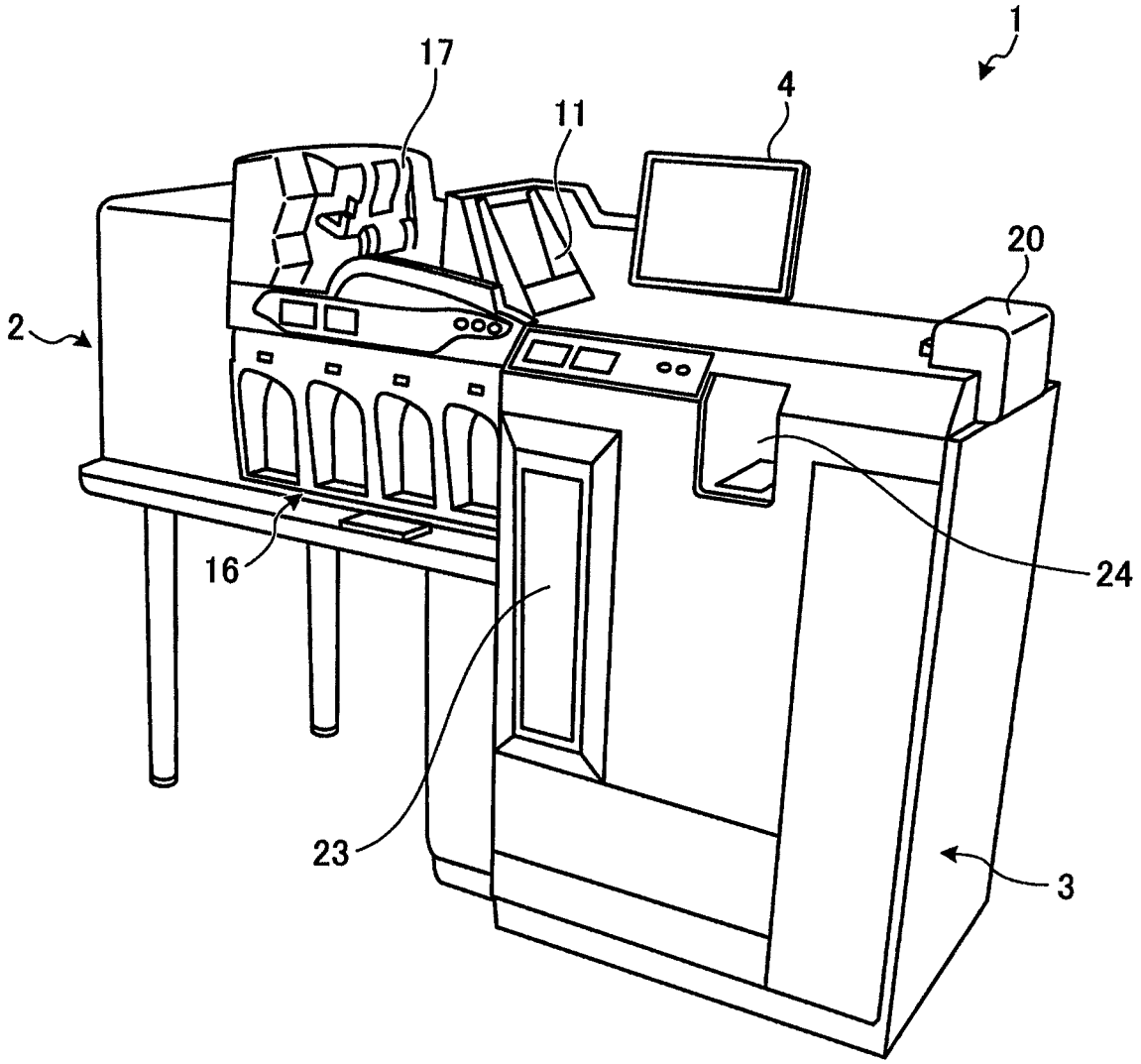
FIG. 1 is a perspective view for clearly showing an outer appearance of a banknote sorting and bundling apparatus according to an embodiment.

1 Banknote sorting and bundling apparatus
2 Banknote processing apparatus
3 Banknote bundling device
4 Display device
11 Hopper unit
12 Feeding unit
13 Banknote transport unit
14 Banknote recognition unit
15 Banknote reversing unit
15A Reversing unit
16 Serial-number identification unit
17 Stacker
17A First stacker
17B Second stacker
17C Third stacker
17D Fourth stacker
17E Stacking wheel
18 First reject unit
18A First reject unit
18B First reject unit
19 Banknote transport path
19A First transport path
19B Second transport path
19C Third transport path
20 Detection sensor
21 Bundling-side stacker
21A First bundling-side stacking unit
21B Second bundling-side stacking unit
21C Third bundling-side stacking unit
22 Bundling unit
22A Bundling stage
23 Bundle dispensing outlet
24 Loose-banknotes returning outlet
25 Pre-bundling transport unit
26 Post-bundling transport unit
27 Hold and transport unit
27A Holding unit
28 Dispensing transport unit
31 Stacking space
41 Hand unit
41A Upper hand
41B Lower hand
41C Driving belt
42 Transport unit
43 Horizontal movement mechanism
44 Vertical movement mechanism
44A Guiding shaft
44B Driving belt
51 Bundling tape reel
52 Driving roller
53 Bundling tape stopper
54 Rotating arm
55 Printer
56 Cutter
57 Heater
61 Bundled-banknotes lifting unit
62 Pushing mechanism
63 Dispensing hold mechanism
63A Bundled-banknotes stacking unit
63B Bundled-banknotes stage
110 stacking-side mechanism
120 bundling-side mechanism
130 bundling-tape mechanism
140 Operation unit
150 Display control unit
160 Banknote-bundle managing unit
170 Drive control unit
180 Control unit
181 Bundling-object-banknote number determining unit

182 Temporary storage unit
183 Bundle-ID creating unit
184 Print control unit
185 Storage control unit
186 Bundle-ID searching unit
190 Second reject unit
191 Stacking wheel
192 Aligner wheel
201 Bundling date and time
202 Apparatus number
203 Operator name
204 Bundle ID
P Bundling-object-banknote
P1 Bundle of banknotes
R Bundling tape

BEST MODE(S) FOR CARRYING OUT THE INVENTION

Exemplary embodiments of a banknote bundling device according to the present invention will be explained below in detail with reference to the accompanying drawings.

An overview of an embodiment will be explained first. A banknote bundling device makes a bundle of banknotes by bundling one-hundred bundling-object-banknotes of a certain kind, from among deposited banknotes, with a bundling tape. The banknote bundling device includes a serial-number identification unit that identifies, for each banknote, a serial number by which the banknote can be uniquely identified, a bundle-ID creating unit that creates, for each bundle of banknotes, a bundle ID associated with the serial numbers of the bundled banknotes, and a print control unit that controls operations of a printer to print, for each bundle of banknotes, the bundle ID created by the bundle-ID creating unit on the bundling tape of the bundle of banknotes.

Consequently, in the present embodiment, the banknote bundling device acquires the serial numbers of all the banknotes of the bundles, creates, for each bundle, a bundle ID associated with the serial numbers of all the banknotes of the bundle, and prints the bundle ID on a bundling tape of each of the bundle of banknotes. Therefore, even if a false claim is made regarding the valid bundle of banknotes dispensed by a financial institution deploying the banknote bundling device, because the serial numbers of the bundled banknotes can be obtained from the bundle ID printed on the bundling tape due to association between the serial numbers and the bundle ID, the financial institution can adequately handle the false claim and surely protect its own credibility through comparison and checking operation based on the serial numbers.

Embodiment

Figure 2:
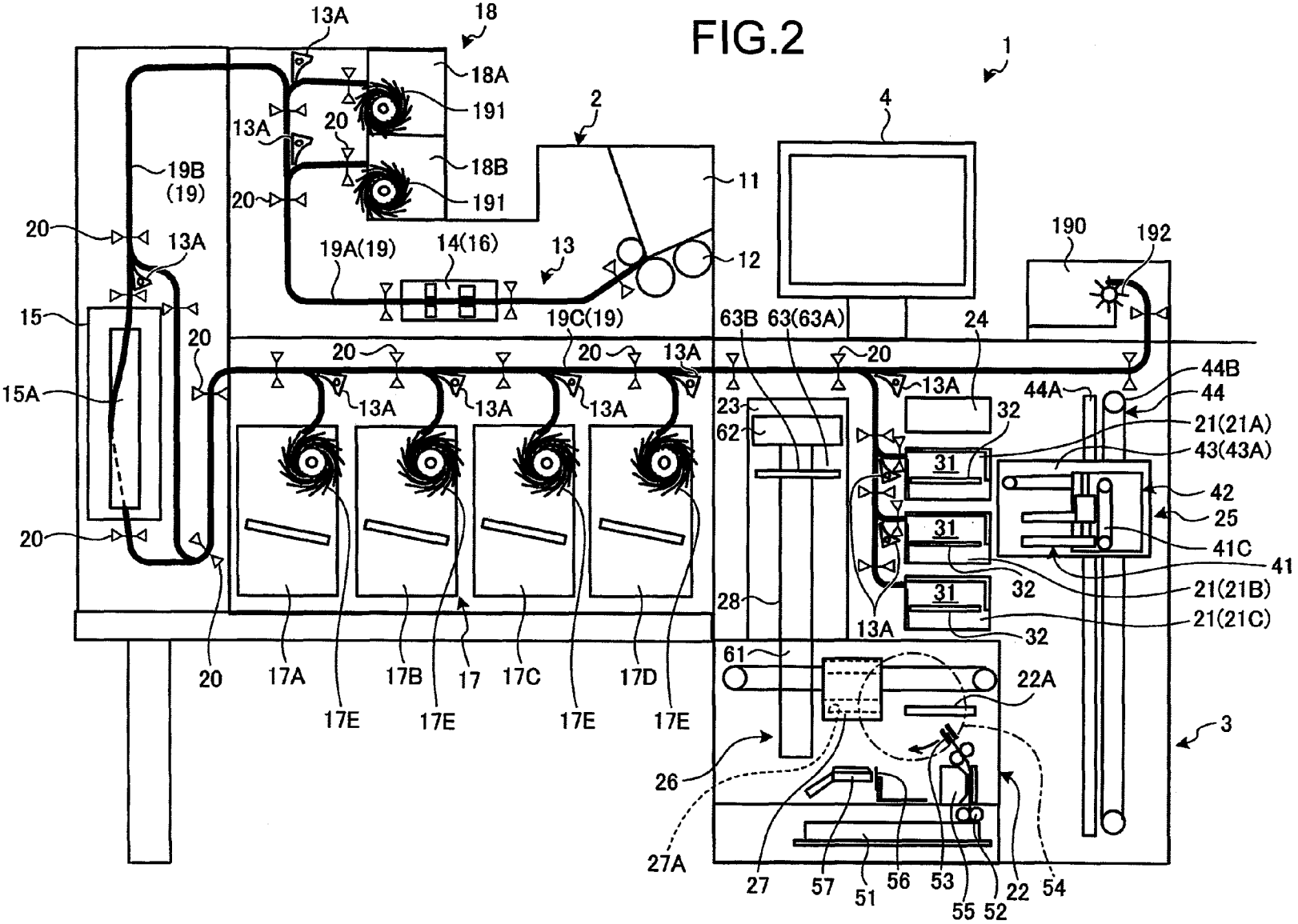
FIG. 2 is a schematic drawing of an internal structure of the banknote sorting and bundling apparatus.

FIG. 1 is a perspective view for clearly showing an outer appearance of a banknote sorting and bundling apparatus 1 according to an embodiment of the present invention. FIG. 2 is a schematic drawing of an internal structure of the banknote sorting and bundling apparatus 1.

The banknote sorting and bundling apparatus 1 includes a banknote processing device 2, a banknote bundling device 3, and a display device 4. The banknote processing device 2 accepts continuous deposits of banknotes in transaction as well, sorts and stacks the deposited banknotes by banknote-kind, and counts the deposited number of banknotes by banknote-kind. The banknote bundling device 3 bundles a predetermined number of banknotes, for example, every one hundred banknotes, of a specific denomination sorted by the banknote processing device 2. The display device 4 displays various kinds of information such as a count result.

The banknote processing device 2 includes a hopper unit 11 for depositing banknotes in transaction into the apparatus; a feeding unit 12 that feeds the banknotes, one by one, deposited in the hopper unit 11; a banknote transport unit 13, such as a transport belt, that transports the banknotes fed by the feeding unit 12; and a banknote recognition unit 14 that recognizes the kind of the banknote transported by the banknote transport unit 13.

The banknote processing device 2 further includes a banknote reversing unit 15 that reverses the banknote transported by the banknote transport unit 13 based on face/back information obtained from the banknote recognition unit 14 so that all the banknotes face in the same direction, either face-up or face-down; and a serial-number identification unit 16 that acquires a banknote image of the front face and back faces of the banknote transported by the banknote transport unit 13 and identifies a serial number printed on the banknote based on the banknote image.

The banknote processing device 2 further includes four stackers 17 for sorting and stacking the banknotes transported by the banknote transport unit 13 according to a banknote-kind and two first reject units 18 for rejecting banknotes that are not fit into the banknote kinds corresponding to the stackers 17 and the banknote bundling device 3. A stacking wheel 17E (191) that stacks the banknote that is being transported, one at a time, at a predetermined position in a banknote stacking space, is arranged in each of the stackers 17 and the first reject units 18.

The four stackers 17 for sorting and stacking the transported banknotes based on a banknote-kind comprise a first stacker 17A, a second stacker 17B, a third stacker 17C, and a fourth stacker 17D. The term banknote-kind refers to, if US dollar is taken as an example, the seven denominations of US dollar, namely, 1 USD, 2 USD, 5 USD, 10 USD, 20 USD, 50 USD, and 100 USD, as well as, for each denomination, printed version information that identifies a new version note or an old version note, authentication information that identifies a genuine note or a counterfeit note, fitness information that identifies a fit note or an unfit note, face/back information that identifies a banknote is face-up or face-down, etc.

The banknote bundling device 3 includes the banknote transport unit 13 that transports the banknote of the specific denomination from a banknote transport path 19 arranged in the banknote processing device 2 into the banknote bundling device 3; three bundling-side stacking units 21 for sorting and stacking the transported banknotes of the specific denominations, and that are arranged at three levels in a vertical direction inside the banknote bundling device 3; and a bundling unit 22 that is arranged below the three bundling-side stacking units 21 for bundling the bundling-object-banknotes sorted and stacked in the bundling-side stacking unit 21 when the number of bundling-object-banknotes reaches a predetermined number, for example, one hundred.

The banknote bundling device 3 further includes a bundle dispensing outlet 23 that is located near the hopper unit 11 and that dispenses the banknotes bundled by the bundling unit 22, that is the bundle of banknotes, so that an operator can collect them; and a loose-banknotes returning outlet 24 that is located near the bundling-side stacking unit 21 and that dispenses loose banknotes stacked in the bundling-side stacking unit 21 at the end of a transaction, so that the operator can collect them.

The banknote bundling device 3 further includes a pre-bundling transport unit 25 that holds and transports the bundling-object-banknotes stacked in the bundling-side stacking unit 21 to the bundling unit 22 or to the loose-banknotes returning outlet 24; and a post-bundling transport unit 26 that holds and transports the bundling-object-banknotes in the bundling unit 22 in a long-edge direction of the banknote and that holds and transports the bundle of banknotes bundled by the bundling unit 22 to the bundle dispensing outlet 23.

The pre-bundling transport unit 25 holds, from a long-edge side, one-hundred bundling-object-banknotes from among the bundling-object-banknotes stacked in the bundling-side stacking unit 21 and transports the one-hundred bundling-object-banknotes onto a bundling stage 22A of the bundling unit 22. At the end of a transaction, the pre-bundling transport unit 25 holds the loose banknotes, whose number does not reach one hundred, from among the bundling-object-banknotes stacked in the bundling-side stacking unit 21 and transports the loose banknotes to the loose-banknotes returning outlet 24. The bundling stage 22A of the bundling unit 22 corresponds to a bundling operation area of the bundling unit 22.

The post-bundling transport unit 26 includes a hold and transport unit 27 that, after the pre-bundling transport unit 25 transports the bundling-object-banknotes onto the bundling stage 22A of the bundling unit 22, holds a short-edge of the transported bundling-object-banknotes, adjusts the movement of the held bundling-object-banknotes in the long-edge direction of the banknote, and holds and transports the bundle of banknotes bundled by the bundling unit 22; and a dispensing transport unit 28 that transports the bundle of banknotes held and transported by the hold and transport unit 27 to the bundle dispensing outlet 23.

The hold and transport unit 27 holds, from the short-edge side, the bundling-object-banknotes at an operation preparation position after the bundling-object-banknotes are transported to the operation preparation position on the bundling stage 22A inside the bundling unit 22 by the pre-bundling transport unit 25 (see FIG. 8C that is described later). The pre-bundling transport unit 25 releases its hold of the long-edge of bundling-object-banknotes as the hold and transport unit 27 holds the bundling-object-banknotes from the short-edge side.

The operation preparation position is a position from where the bundling-object-banknotes are moved to adjust their position toward a bundling operation position on the bundling stage 22A whereon a bundling operation is performed, that is, a position from where a movement of the bundling-object-banknote starts in the long-edge direction. The bundling operation position is a position at which the bundling-object-banknotes are bundled with the bundling tape.

Upon holding the bundling-object-banknotes at the operation preparation position on the bundling stage 22A of the bundling unit 22, the hold and transport unit 27 moves and adjusts the position of the bundling-object-banknotes in the long-edge direction so that the bundling position of the bundling-object-banknotes is set at the bundling operation position on the bundling stage 22A (see FIG. 8E that is described later). The bundling unit 22 wraps the bundling tape around the bundling-object-banknotes at the bundling position when the bundling position of the bundling-object-banknotes matches the bundling operation position.

When bundling of the bundling-object-banknotes by the bundling unit 22 is completed at the bundling operation position on the bundling stage 22A in a state the short-edge of the bundling-object-banknotes are being held by the hold and transport unit 27, the hold and transport unit 27 transports the bundle of banknotes to the operation preparation position and subsequently into the dispensing transport unit 28.

The dispensing transport unit 28 includes a bundled-banknotes lifting unit 61 that transports the bundle of banknotes held and transported by the hold and transport unit 27 to an upper part of the banknote bundling device 3, a pushing mechanism 62 that pushes the bundle of banknotes, transported to the upper part of the banknote bundling device 3 by the bundled-banknotes lifting unit 61, towards the bundle dispensing outlet 23 (towards a front side of the apparatus), and a dispense/hold mechanism 63 that receives the bundle of banknotes pushed to the front side of the apparatus by the pushing mechanism 62 and holds the bundle of banknotes at the position of the bundle dispensing outlet 23 for dispensing the bundle of banknotes.

The banknote sorting and bundling apparatus 1 further includes the banknote transport path 19 that in turn includes a first transport path 19A that is connected to the hopper unit 11 and that passes above the stackers 17, a second transport path 19B that is connected to the first transport path 19A and that bends back in an arrangement direction of the stackers 17, and a third transport path 19C that is connected to the second transport path 19B, the stackers 17, and the bundling-side stacking unit 21. The banknote recognition unit 14 is arranged on the first transport path 19A and the banknote reversing unit 15 is arranged on the second transport path 19B. The second transport path 19B is configured as a removable unit that connects the first transport path 19A and the third transport path 19C of the banknote sorting and bundling apparatus 1.

Detection sensors 20 for detecting approaches or passes of banknotes at each branching point, merging point, and device linkage point are arranged at each of the above-mentioned points on the banknote transport path 19.

A second reject unit 190 is arranged at the end of the third transport path 19C. A banknote aligner wheel 20A that stacks the transported banknote, one at a time, at a predetermined position in a banknote stacking space is arranged in the second reject unit 190.

A diverting unit 13A is arranged at each of the branching points on the banknote transport path 19. The diverting unit 13A diverts the banknote transported through the banknote transport path 19 to the stackers 17, the bundling-side stacking unit 21, the first reject units 18A or the second reject unit 190. The diverting units 13A are driven by a not shown solenoid when the detection sensor 20 detects an approach of a leading edge of the banknote, and performs the diverting of the banknote.

The banknote reversing unit 15 diverts the banknote, based on the face/back information obtained from the banknote recognition unit 14, into a reversing route or a non-reversing route by the diverting unit 13A that is arranged upstream of the banknote reversing unit 15 so that all the banknotes are transported through the third transport path 19C with faces in the same direction, either face-up or face-down.

The reversing route includes a reversing member 15A that has a curved surface and that extends along a transport direction of the banknote, a not shown transport belt that is winded obliquely relative to a longitudinal direction of the reversing member 15A with a part of the transport belt running along the curved surface of the reversing member 15A, a not shown driving motor that drives the transport belt, and a not shown guide unit guiding the banknote while the banknote is transported, in the longitudinal direction of the reversing member 15A, in the state of being wrapped around the curved surface of the reversing member 15A and is held between the transport belt and the reversing member 15A (see Japanese Patent No. 4119664).

In the banknote reversing unit 15, when the transport belt is being driven by the driving motor, the banknote moves in the transport direction as the transport belt moves while the banknote is being held between the transport belt and the reversing member 15A. Because the transport belt is winded obliquely relative to the longitudinal direction of the reversing member 15A, the banknote is transported in the state of being wrapped around the curved surface and is reversed during the transport. During the reversing of the banknote, the guide unit ensures that the banknote is reversed properly by restricting a movement of the banknote and guiding so that the banknote is slid on the surface of the guide unit.

Figure 3:
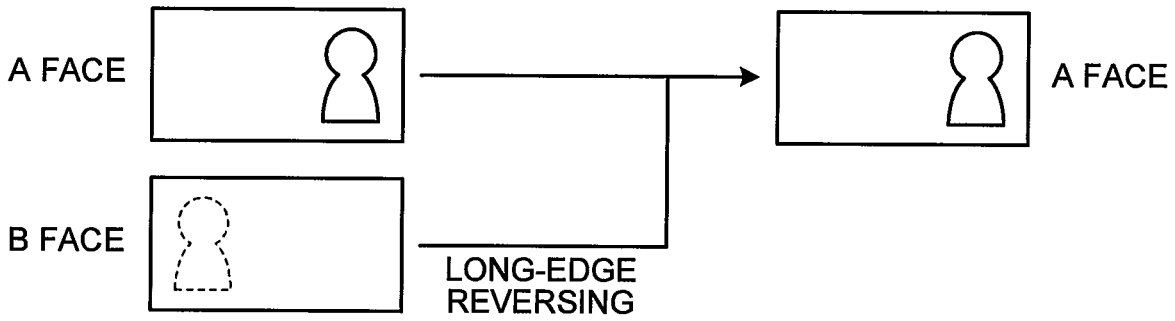
FIG. 3 is a drawing for clearly explaining a reversing process performed by a banknote reversing unit.

FIG. 3 is a drawing for clearly explaining a reversing process performed by the banknote reversing unit 15.

When transporting the banknote with an A face (front face), shown in FIG. 3, to the third transport path 19C, the banknote reversing unit 15 transports the banknote via a non-reversing route without performing a reversing process so that the banknote with the A face (front face) is transported to the third transport path 18C.

When transporting the banknote with a B face (back face), shown in FIG. 3, to the third transport path 19C, the banknote reversing unit 15 transports the banknote with the B face (back face) via a reversing route by performing a long-edge direction reversing process so that the banknote is reversed, and therefore, the banknote with the A face (front face) is transported to the third transport path 19C.

Three openings, for example, are provided through a back side wall of the bundling-side stacking unit 21 to allow a hand unit 41 (see FIG. 2) of the pre-bundling transport unit 25 to advance into the stacking space 31 and hold the bundling-object-banknotes stacked in the stacking space 31. A shutter mechanism that can be opened and closed is provided below the back side wall to allow the hand unit 41 to pull out the bundling-object-banknotes from the stacking space 31.

As shown in FIG. 2, the pre-bundling transport unit 25 includes a transport unit 42 that has the hand unit 41 that holds bundling-object-banknotes stacked in the bundling-side stacking unit 21, a horizontal movement mechanism 43 that moves the transport unit 42 forward and backward (horizontal direction), and a vertical movement mechanism 44 that moves the transport unit 42 upward and downward (vertical direction).

The vertical movement mechanism 44 includes a guiding shaft 44A that is vertically placed and that extends from a bottom end to a top end of the banknote bundling device 3, and a driving belt 44B that raises and lowers the transport unit 42 along the guiding shaft 44A.

The transport unit 42 arranged in the pre-bundling transport unit 25 includes the hand unit 41 that can be moved forward and backward by a driving belt 43A arranged in the horizontal movement mechanism 43. The hand unit 41 includes an upper hand 41A with three holding pawls and a lower hand 41B with three holding pawls facing each other and holds the bundling-object-banknotes stacked in the bundling-side stacking unit 21 with the opposing sets of holding pawls. The lower hand 41B is fixed whereas the upper hand 41A is movable up and down by a driving belt 41C.

The transport unit 42 holds the long-edge of the bundling-object-banknotes by the opposing holding pawls of the upper hand 41A and the lower hand 41B, and transports the bundling-object-banknotes to the operation preparation position on the bundling stage 22A inside the bundling unit 22 or to the loose-banknotes returning outlet 24.

The pre-bundling transport unit 25 transports the one hundred bundling-object-banknotes, with the long-edge of the bundling-object-banknotes held by the transport unit 42, to the operation preparation position on the bundling stage 22A inside the bundling unit 22.

The hold and transport unit 27 holds, from the short-edge side, the one hundred bundling-object-banknotes at the operation preparation position on the bundling stage 22A inside the bundling unit 22 in a state the bundling-object-banknotes are being held from the long-edge side by the transport unit 42. As the hold and transport unit 27 holds the short-edge of the bundling-object-banknotes, the transport unit 42 inside the pre-bundling transport unit 25 releases its hold of the long-edge of the bundling-object-banknotes and moves to a standby position.

The hold and transport unit 27 includes a holding unit 27A having upper and lower hands that together hold the banknotes from the short-edge side. The holding unit 27A moves and adjusts the position of the bundling-object-banknotes from the operation preparation position, in the long-edge direction, so that the bundling position of the bundling-object-banknotes matches the bundling operation position on the bundling stage 22A.

When the bundling position of the bundling-object-banknotes matches the bundling operation position on the bundling stage 22A with the short-edge of the bundling-object-banknotes are being held by the holding unit 27A inside the hold and transport unit 27, the bundling unit 22 bundles the bundling-object-banknotes with the bundling tape at the bundling position.

The bundling unit 22 includes a bundling tape reel 51 on which the bundling tape is winded, a driving roller 52 that feeds the bundling tape from the bundling tape reel 51, a bundling tape stopper 53 that stops a leading edge of the bundling tape being drawn from the bundling tape reel 51 at a bundling position of the bundling-object-banknotes that is aligned with the bundling operation position, and a rotating arm 54 that draws, from the bundling tape reel 51, the bundling tape of which the leading edge has been stopped at the bundling position of the bundling-object-banknotes and wraps the bundling tape around the bundling-object-banknotes at the bundling position.

The bundling unit 22, that makes the bundle of banknotes by bundling the bundling-object-banknotes with the bundling tape, further includes a printer 55 that performs printing on the bundling tape, a cutter 56 that cuts other end of the bundling tape after the bundling-object-banknotes have been bundled at the bundling position, and a heater 57 that thermally bonds the other end of the bundling tape cut by the cutter 56.

The driving roller 52 feeds a bundling tape R from the bundling tape reel 51 by a forward rotation operation and rewinds the bundling tape R on the bundling tape reel 51 by a reverse rotation operation.

Figures 5, 6:
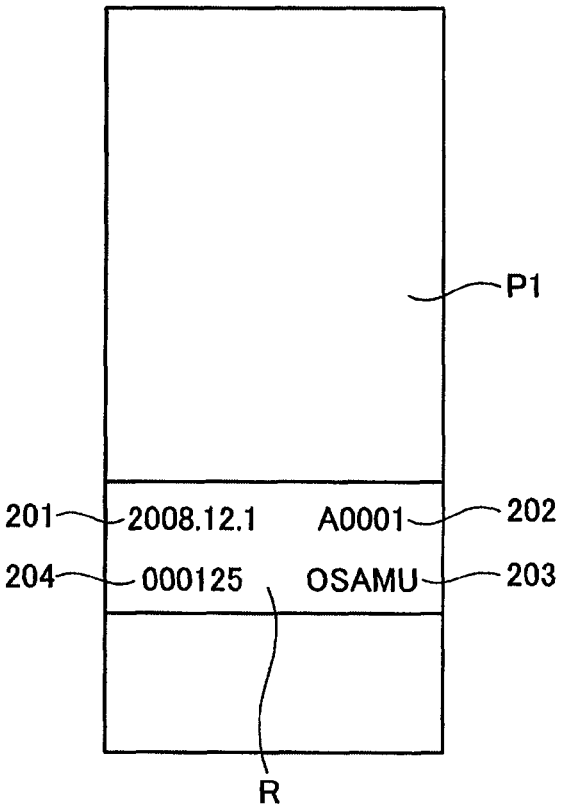
FIG. 5 is a table for clearly explaining the contents of a banknote-bundle managing unit.
FIG. 6 is a drawing for clearly showing information printed on a bundling tape of a bundle of banknotes.

The printer 55 prints information on the bundling tape R when the bundling tape R passes over a printing head. The information printed on the bundling tape R includes, as shown in FIG. 6, bundling date and time 201 when the bundle of banknotes was bundled, an apparatus number 202 indicates the banknote bundling device 3, an operator name 203 that indicates the operator, a bundle ID 204 for distinguishing each of the bundle of banknotes, etc.

As shown in FIG. 2, when the bundling unit 22 completes the bundling operation of the bundling-object-banknotes, the holding unit 27A of the hold and transport unit 27 returns the bundle of banknotes to the operation preparation position and transports the bundle of banknotes into the bundled-banknotes lifting unit 61 of the dispensing transport unit 28 through a bundled-banknotes transport path. Moreover, upon transporting the bundle of banknotes into the bundled-banknotes lifting unit 61, the hold and transport unit 27 releases its hold on the short-edge of the bundle of banknotes.

The bundled-banknotes lifting unit 61 transports the bundle of banknotes held and transported by the hold and transport unit 27 toward the pushing mechanism 62 in the upper part of the banknote bundling device 3.

The pushing mechanism 62 pushes and transports the bundle of banknotes to the dispense/hold mechanism 63 in a direction of the bundle dispensing outlet 23 (towards the front side of the apparatus) by pushing the bundle of banknotes transported to the upper part of the banknote bundling device 3 by the bundled-banknotes lifting unit 61.

The dispense/hold mechanism 63 includes a bundled-banknotes stacking unit 63A in which the bundle of banknotes, that is pushed and transported by the pushing mechanism 62, is stacked, and a bundled-banknotes stage 63B for placing the bundle of banknotes stacked in the bundled-banknotes stacking unit 63A. The dispense/hold mechanism 63 adjusts a height of the bundled-banknotes stage 63B so that the bundle of banknotes pushed by the pushing mechanism 62 comes to rest on the topmost bundle of banknotes resting on the bundled-banknotes stage 63B.

FIG. 4 is a schematic block diagram of internal structure of the banknote sorting and bundling apparatus 1.

The banknote sorting and bundling apparatus 1 shown in FIG. 4 includes, apart from the banknote recognition unit 14 and the serial-number identification unit 16, a stacker-side mechanism 110 arranged inside the banknote processing device 2; a bundling-side mechanism 120 arranged inside the banknote bundling device 3; a bundling-tape mechanism 130 of the bundling unit 22 arranged in the banknote bundling device 3; an operation unit 140 for inputting various commands; and a display control unit 150 that performs a display control of the display device 4.

The banknote sorting and bundling apparatus 1 further includes a banknote-bundle managing unit 160 that stores therein and manages various kinds of information pertaining to the bundle of banknotes made by the bundling unit 22, a drive control unit 170 that performs a drive control on the stacker-side mechanism 110, the bundling-side mechanism 120, and the bundling-tape mechanism 130, and a control unit 180 that performs an overall control of the banknote sorting and bundling apparatus 1.

The stacker-side mechanism 110 includes the feeding unit 12, the banknote transport unit 13, the banknote reversing unit 15, the stacking wheel 16E (17C), the detection sensors 20 and the diverting units 13A of the banknote processing device 2.

The bundling-side mechanism 120 includes the detection sensors 20, the banknote transport unit 13, the diverting units 13A, the bundling unit 22, the pre-bundling transport unit 25, the post-bundling transport unit 26, of the banknote bundling device 3. The post-bundling transport unit 26 includes the hold and transport unit 27 and the dispensing transport unit 28.

The bundling-tape mechanism 130 includes the driving roller 52 and the printer 55.

The drive control unit 170 controls the holding unit 27A of the hold and transport unit 27 so that the bundling position of the bundling-object-banknotes matches the bundling operation position on the bundling stage 22A of the bundling unit 22.

The control unit 180 sets the banknote-kind to be stacked (stacking banknote) in each of the stackers 17, the first reject units 18, the second reject unit 190, and the bundling-side stacking units 21. For example, the control unit 180 sets fit and unfit 1 USD banknote for the first stacker 17A, fit and unfit 5 USD banknote for the second stacker 17B, fit and unfit 50 USD for the third stacker 17C, and fit and unfit 100 USD for the fourth stacker 17D. Furthermore, as initial settings, 10 USD banknote for a first bundling-side stacking unit 21A, 20 USD banknote for a second bundling-side stacking unit 21B, a spare for a third bundling-side stacking unit 21C, fit and unfit 2 USD for a first reject unit 18A, and any banknote-kind, other than those that have been set, for a first reject unit 18B. The first reject unit 18B can be used as a stacker for stacking rare kinds of banknotes such as 2 USD banknotes.

The control unit 180 identifies errors such as jamming of the banknotes on the transport path, based on detection result of the detection sensor 20.

The control unit 180 includes a bundling-object-banknote number determining unit 181 that determines whether the number of the bundling-object-banknotes P stacked in the one bundling-side stacking unit 21 of the three bundling-side stacking units 21 has reached one hundred, and a temporary storage unit 182 that temporarily stores the serial numbers of the bundling-object-banknotes that have been recognized by the serial-number identification unit 16.

The control unit 180 further includes a bundle-ID creating unit 183 that creates the bundle ID 204 for distinguishing the bundle of banknotes made by the bundling unit 22 when the bundling-object-banknote number determining unit 181 determines that the number of the bundling-object-banknotes P has reached one hundred, and a print control unit 184 that controls the printer 55 to print the bundle ID 204 on the bundling tape R of the bundle of banknotes made by the bundling unit 22.

The control unit 180 further includes a storage control unit 185 that stores, in the banknote-bundle managing unit 160, the serial numbers of all the banknotes in a bundle for each bundle ID 204, and a bundle-ID searching unit 186 that searches, from the banknote-bundle managing unit 160, the serial numbers of all the banknotes of the bundle corresponding to the bundle ID 204 that is inputted by the operation unit 140 as a target ID 204 to be searched.

The temporary storage unit 182 sequentially stores therein the serial numbers, of the bundling-object-banknotes stacked in the bundling-side stacking unit 21, that have been recognized by the serial-number identification unit 16. The serial numbers are separately stored for each of the bundling-side stacking units 21 (21A, 21B, and 21C)

The bundle-ID creating unit 183 creates the bundle ID 204 for distinguishing the bundle of banknotes made by the bundling unit 22 when the bundling-object-banknote number determining unit 181 determines that the number of the bundling-object-banknotes P has reached one hundred.

The print control unit 184 controls the printer 55 to print the bundle ID 204 created by the bundle-ID creating unit 183 on the bundling tape R of the bundle of banknotes made by the bundling unit 22. The information printed on the bundling tape R of the bundle of banknotes includes, as shown in FIG. 6, the bundle ID 204 apart from the bundling date and time 201, the apparatus number 202, and the operator name 203.

The storage control unit 185 reads out the serial numbers of all the banknotes of the bundle corresponding to the bundle ID 204 from the temporary storage unit 182 and stores the read serial numbers 160B in the banknote-bundle managing unit 160 in an associated form with a bundle ID 160A (204) of the bundle of banknotes. FIG. 5 is for clearly explaining the contents of the table in the banknote-bundle managing unit 160.

The banknote-bundle managing unit 160 shown in FIG. 5 manages the serial numbers 160B of all the banknotes of the bundle P1 for each bundle ID 160A (204) of bundle of banknotes P1 formed from the bundling-object-banknotes P that are stacked in the bundling-side stacking unit 21.

Upon detection of an input of the target bundle ID 204 by the operation unit 140, the bundle-ID searching unit 186 searches for the serial numbers 160B of all the banknotes of the bundle of banknotes P1 corresponding to the inputted bundle ID 204 from the banknote-bundle managing unit 160 and causes the display control unit 150 to display, on the display unit, the serial numbers 160B of all the banknotes of the bundle of banknotes P1 as the search result. For example, when a false claim is made against the bundle of banknotes P1, the operator of the financial institution can look at the bundle ID 204 printed on the bundling tape R of the bundle of banknotes P1 and inputs the bundle ID 204 via the operation unit 140 as the target bundle ID 204.

Consequently, based on the serial numbers of all the banknotes in the target bundle of banknotes P1 displayed on the display device 4, the operator can check whether the banknotes in the bundle of the false claim are of the valid bundle dispensed by the financial institution, and can adequately respond to the false claim by comparing the displayed serial numbers with those of the banknotes in the bundle of the false claim.

Upon receiving the banknote-kind of the transported banknote recognized by the banknote recognition unit 14, if the banknote being transported through the banknote transport path 19 is of the banknote-kind (stacking banknote) set for any of the stackers 17 or the bundling-side stacking units 21, the drive control unit 170 performs the drive control of the banknote transport unit 13 and the diverting units 13A so that the banknote being transported is sorted and stacked in the stacker 17 or the bundling-side stacking unit 21 corresponding to the banknote-kind.

If the banknote being transported through the banknote transport path 19 is not of the banknote-kind set for any one of the stackers 17 and the bundling-side stacking units 21, or if the banknote cannot be recognized due to transport error, etc., the drive control unit 170 performs the drive control of the banknote transport unit 13 and the diverting units 13A so that the banknote is transported to the first reject unit 18A. Moreover, because a banknote-kind can be set to the first reject unit 18A, upon receiving the banknote-kind of the transported banknote recognized by the banknote recognition unit 14, if the banknote being transported through the banknote transport path 19 is of the banknote-kind (stacking banknote) set for the first reject unit 18A, the drive control unit 170 performs the drive control of the banknote transport unit 13 and the diverting units 13A so that the banknote is transported to the first reject unit 18A.

If the banknote being transported through the banknote transport path 19 is of the banknote-kind (stacking banknote) that is set for the bundling-side stacking unit 21, the drive control unit 170 controls the banknote transport unit 13 and the diverting units 13A so that the transported banknote is sorted and stacked in the bundling-side stacking unit 21.

For example, if the banknote-kind (stacking banknote) set for the first bundling-side stacking unit 21A is fit 10 USD, the banknote-kind set for the second bundling-side stacking unit 21B is fit 20 USD, and the third bundling-side stacking unit 21C is set as a spare stacking unit, and if the number of the bundling-object-banknotes P stacked in the first bundling-side stacking unit 21A has reached one hundred, the drive control unit 170 performs the drive control of the pre-bundling transport unit 25 so that the hand unit 41 arranged in the transport unit 42 of the pre-bundling transport unit 25 draws out the bundling-object-banknotes stacked in the first bundling-side stacking unit 21A.

When the number of the fit 10 USD banknotes stacked in the first bundling-side stacking unit 21A reaches one hundred, the control unit 180 switches the banknote-kind (stacking banknote) for the spare third bundling-side stacking unit 21C to fit 10 USD, and once the one hundred banknotes of 10 USD are drawn out by the hand unit 41 arranged in the transport unit 42, switches the banknote-kind (stacking banknote) for the first bundling-side stacking unit 21A to the spare.

FIGS. 7A to 7D are drawings for clearly explaining action transitions of the pre-bundling transport unit 25.

Figure 7A:
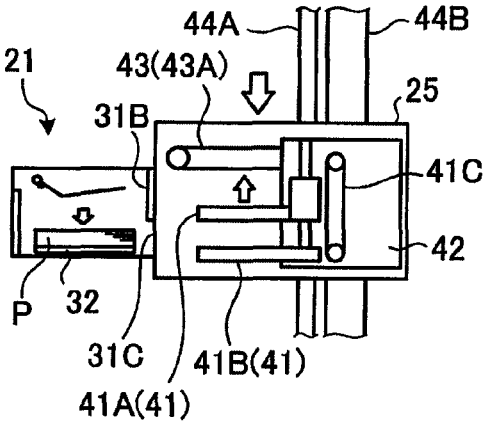
FIGS. 7A to 7D are drawings for clearly explaining action transitions of a pre-bundling transport unit.

When the bundling-object-banknotes stacked in the bundling-side stacking unit 21 are drawn out by the transport unit 42, the pre-bundling transport unit 25 moves, downward to a level of the lowermost edge, the stage member 32 arranged in the bundling-side stacking unit 21 in which the bundling-object-banknotes to be drawn out are stacked (see FIG. 7A).

The transport unit 42 of the pre-bundling transport unit 25, through the action of the driving belt 44B, moves downward along the guiding shaft 44A to a position corresponding to the bundling-side stacking unit 21 in which the bundling-object-banknotes to be drawn out are stacked, that is, to a position where an upper surface of the lower hand 41B is lower than the bottommost banknote of the bundling-object-banknotes stacked in the bundling-side stacking unit 21 (see FIG. 7A).

Meanwhile, the upper hand 41A of the transport unit 42 of the pre-bundling transport unit 25 is moved upward, through the action of the driving belt 41C, to a position where an lower surface of the upper hand 41A is higher than the topmost banknote of the bundling-object-banknotes stacked in the bundling-side stacking unit 21 (see FIG. 7A). Thus, there is a wide gap between the upper hand 41A and the lower hand 41B.

Figure 7B:
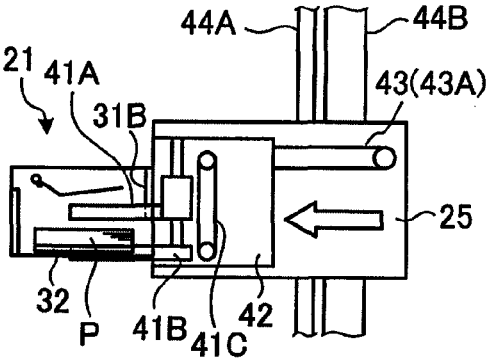

The transport unit 42 is moved forward through the action of the driving belt 43A of the horizontal movement mechanism 43, and the movement causes the upper hand 41A and the lower hand 41B advance into the bundling-side stacking unit 21 through the opening 31C formed on the back side wall 31B of the bundling-side stacking unit 21 and be positioned such that the bundling-object-banknotes are disposed between the upper hand 41A and the lower hand 41B (see FIG. 7B).

Figure 7C:
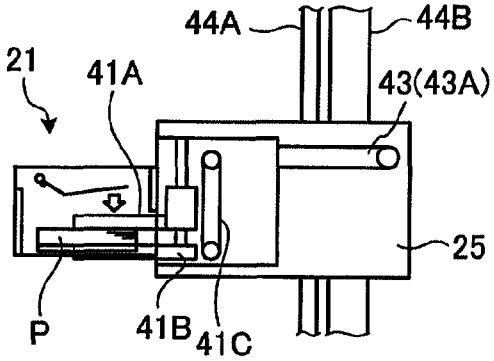

The upper hand 41A of the transport unit 42 is moved downward through the action of the driving belt 41C, so that the bundling-object-banknotes on the stage member 32 are tightly held between the upper hand 41A and the lower hand 41B (see FIG. 7C).

Figure 7D:
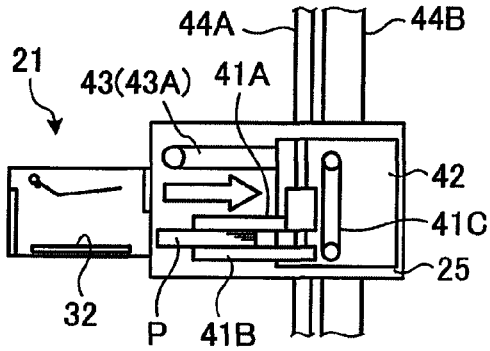

Thereafter, the transport unit 42 moves backward through the action of the driving belt 43A of the horizontal movement mechanism 43, and thus, the bundling-object-banknotes P held by the upper hand 41A and the lower hand 41B are ready to be transported to the operation preparation position on the bundling stage 22A inside the bundling unit 22 or the loose-banknotes returning outlet 24 by the vertical movement mechanism 44 (see FIG. 7D).

The drive control unit 170 shown in FIG. 4 performs the drive control of the pre-bundling transport unit 25 so that, when the number of the bundling-object-banknotes P stacked in the bundling-side stacking unit 21 reaches one hundred, the hand unit 41 of the transport unit 42 inside the pre-bundling transport unit 25 advances into the stacking space 31 through the opening 31C of the back side wall 31B, holds the long-edge of the bundling-object-banknotes on the stage unit 32, and draws out the held bundling-object-banknotes from the bundling-side stacking unit 21 in order to transport the drawn bundling-object-banknotes to the bundling unit 22 by the horizontal movement mechanism 43, the vertical movement mechanism 44 and the horizontal movement mechanism 43.

Furthermore, at the end of the transaction when the number of the bundling-object-banknotes P stacked in the bundling-side stacking unit 21 does not reach one hundred, the drive control unit 170 performs the drive control of the pre-bundling transport unit 25 so that the hand unit 41 of the transport unit 42 advances into the stacking space 31 through the opening 31C of the back side wall 31B, holds the long-edge of the bundling-object-banknotes P on the stage unit 32, and draws out the held loose banknotes of the bundling-object-banknotes from the bundling-side stacking unit 21 in order to transport the drawn loose banknotes to the loose-banknotes returning outlet 24 by the horizontal movement mechanism 43, the vertical movement mechanism 44 and the horizontal movement mechanism 43.

After the bundling-object-banknotes stacked in the bundling-side stacking unit 21 are drawn out, the drive control unit 170 raises the stage member 32 arranged in the bundling-side stacking unit 21 and returns it to a normal standby position for waiting banknotes to be stacked therein.

If a transport error of the banknote being transported is detected by the detection sensor 20 when the banknote is upstream of a first reject unit 18B, the drive control unit 170 sequentially transports the banknote to the first reject unit 18B.

If a transport error is detected by the detection sensor 20 when the banknote is downstream of the first reject unit 18B, the drive control unit 170 performs the drive control of the banknote transport unit 13 and the diverting units 13A so that the banknote is transported to the second reject unit 190. When transport errors, such as skewed state of the banknote on the banknote transport path 19, or chained banknotes on the banknote transport path 19, or double feed of the banknotes on the banknote transport path 19, etc., occur downstream of the first reject unit 18B, that is, on the second transport path 19B or the third transport path 19C, recovery can be achieved quickly by transporting the error banknotes to the second reject unit 190, as compared with stopping the transport of the banknotes.

FIGS. 8A to 8G are drawings for clearly explaining action transitions of the hold and transport unit 27.

Figures 8A, 8B, 8C, 8D, 8E, 8F, 8G:
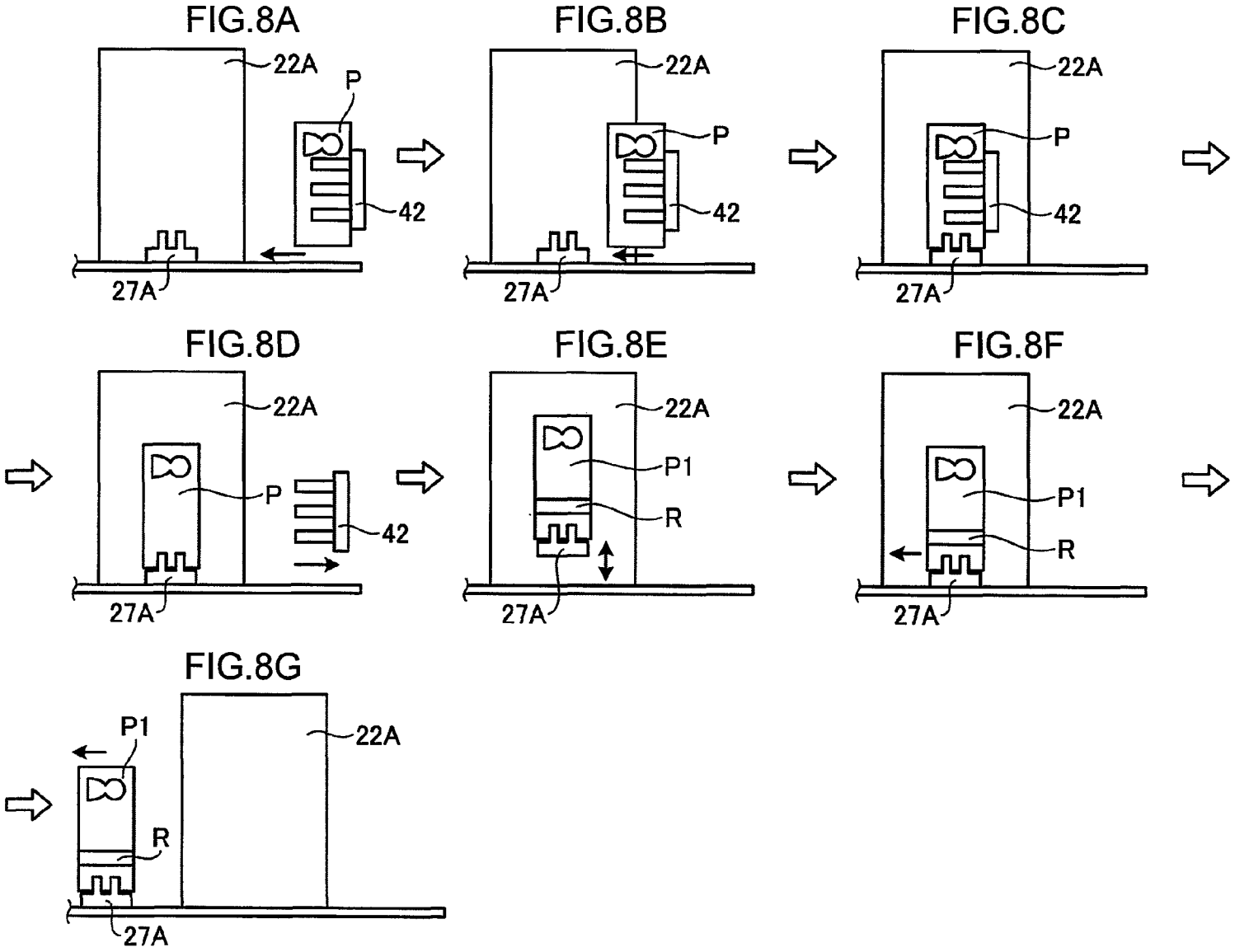
FIGS. 8A to 8G are drawings for clearly explaining action transitions of a hold and transport unit.

In FIG. 8, the transport unit 42 of the pre-bundling transport unit 25 holds the long-edge of the bundling-object-banknotes P stacked in the bundling-side stacking unit 21 and transports the bundling-object-banknotes P to near an entrance of the bundling unit 22 through the horizontal movement mechanism 43 and the vertical movement mechanism 44 (see FIG. 8A). As shown in FIG. 8A, the holding unit 27A of the hold and transport unit 27 is arranged at the operation preparation position on the bundling stage 22A.

The transport unit 42 of the pre-bundling transport unit 25 transports the bundling-object-banknotes P onto the bundling stage 22A inside the bundling unit 22 through the horizontal movement mechanism 43 (see FIG. 8B) and subsequently to the operation preparation position on the bundling stage 22A (see FIG. 8C). As a result, the holding unit 27A of the hold and transport unit 27 holds the short-edge of the bundling-object-banknotes P at the operation preparation position as the bundling-object-banknotes P are transported to the operation preparation position by the transport unit 42 (see FIG. 8C).

As the holding unit 27A of the hold and transport unit 27 holds the bundling-object-banknotes P, the transport unit 42 of the pre-bundling transport unit 25 releases its hold of the long-edge of the bundling-object-banknotes P (see FIG. 8D), and returns to the normal standby position for the stacked bundling-object-banknotes.

The holding unit 27A of the hold and transport unit 27 moves in the long-edge direction so that the bundling position of the bundling-object-banknotes P is aligned with the bundling operation position on the bundling stage 22A (see FIG. 8E). Furthermore, the bundling unit 22 wraps the bundling tape R around the bundling-object-banknotes P at the bundling position that is aligned with the bundling operation position on the bundling stage 22A, and tightens the bundling tape R at the bundling position of the bundling-object-banknotes P in a state the short-edge of the bundling-object-banknotes P are being held by the holding unit 27A.

Thereafter, The holding unit 27A of the hold and transport unit 27 moves the bundle of banknotes P1 at the bundling operation position on the bundling stage 22A to the operation preparation position (see FIG. 8F) and transports it to the dispensing transport unit 28 (see FIG. 8G).

In the claims of the present application, a banknote bundling device corresponds to the banknote bundling device 3, banknote-specific information corresponds to the serial number, a specific-information acquiring unit corresponds to the serial-number identification unit 16, related information corresponds to the bundle ID 204, a related information creating unit corresponds to the bundle-ID creating unit 183, a related information assigning unit corresponds to the print control unit 184 and the printer 55, an information storage managing unit corresponds to the banknote-bundle managing unit 160, an information searching unit corresponds to the bundle-ID searching unit 186, and an information output unit corresponds to the display control unit 150 and the display device 4.

Figure 9:
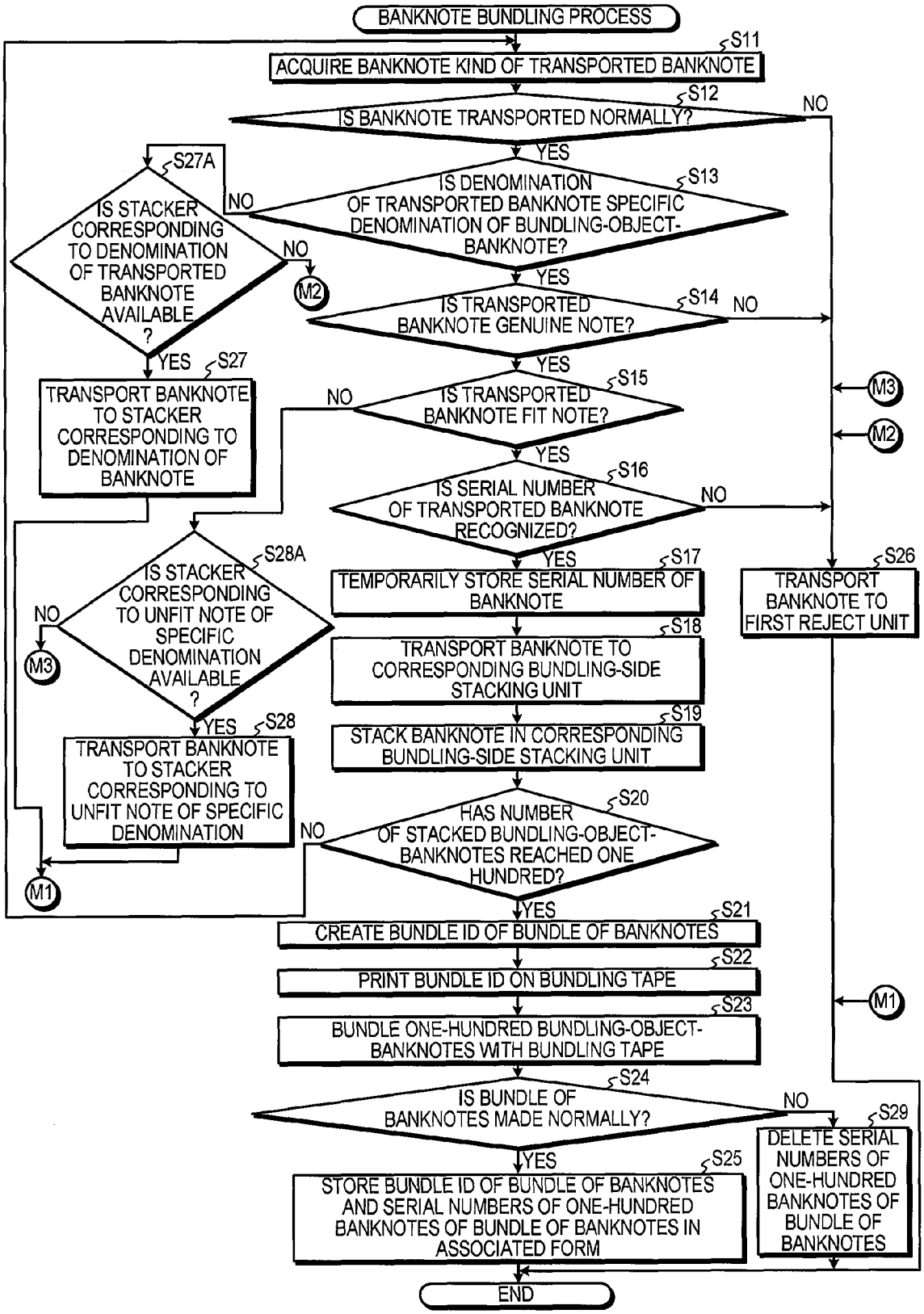
FIG. 9 is a flowchart of a process procedure related to a banknote bundling process performed by a control unit.

Operations performed by the banknote sorting and bundling apparatus 1 according to the present embodiment are explained below. FIG. 9 is a flowchart of a process procedure related to a banknote bundling process performed by the control unit 180.

The banknote bundling process shown in FIG. 9 is a process of printing, when the one-hundred bundling-object-banknotes P stacked in the bundling-side stacking unit 21 are bundled with the bundling tape R to form the bundle of banknotes P1, the bundle ID 204 on the bundling tape R of the bundle of banknotes P1 to distinguish the bundle P1, and storing and managing the serial numbers of all the banknotes of the bundle P1 in an associated form with the bundle ID 204 of the bundle P1 in the banknote-bundle managing unit 160.

As shown in FIG. 9, the control unit 180 acquires the banknote-kind of the banknote being transported on the banknote transport path 19 through the banknote recognition unit 14 (Step S11). The banknote recognition unit 14 recognizes the banknote-kind, for example, denomination information, fitness information, authentication information of the banknote, etc.

The control unit 180 determines whether the banknote is being transported normally (Step S12). If the banknote is being transported normally and the denomination recognition is performed normally (Yes at Step S12), the control unit 180 determines, based on the banknote-kind acquired at Step S11, whether the denomination of the banknote is a specific denomination of the bundling-object-banknotes (Step S13). It is assumed here that the specific denominations of the bundling-object-banknotes are set to, for example, fit 10 USD and fit 20 USD.

If the denomination of the banknote is the specific denomination of the bundling-object-banknote (Yes at Step S13), the control unit 180 determines whether the banknote is a genuine banknote (Step S14).

If the banknote is a genuine banknote (Yes at Step S14), the control unit 180 determines whether the banknote is a fit banknote (Step S15).

If the banknote is a fit banknote (Yes at Step S15), the control unit 180 identifies the serial number of the banknote through the serial-number identification unit 16 (Yes at Step S16), stores the serial number of the banknote, in the temporary storage unit 182, for each of the bundling-side stacking unit 21 in which the banknote is stacked (Step S17), and transports the banknote to the corresponding bundling-side stacking unit 21 (Step S18).

Once the banknote is stacked in the corresponding bundling-side stacking unit 21 (Step S19), the control unit 180 determines whether the number of the bundling-object-banknotes P stacked in the bundling-side stacking unit 21 counted by the bundling-object-banknote number determining unit 181 reaches one hundred (Step S20).

If one hundred bundling-object-banknotes P have been stacked in the bundling-side stacking unit 21 (Yes at Step S20), the control unit 180 controls the bundle-ID creating unit 183 to create the bundle ID 204 of the bundle of banknotes P1 formed by the one-hundred bundling-object-banknotes P (Step S21).

Once the bundle ID 204 of the bundle of banknotes P1 is created by the bundle-ID creating unit 183, the control unit 180 controls the print control unit 184 to print the bundle ID 204 on the bundling tape R through the printer 55 (Step S22).

The control unit 180 causes the bundling unit 22 to make the bundle of banknotes P1 by bundling the one-hundred bundling-object-banknotes P detected at Step S20, with the bundling tape R which is printed at Step S22, at the bundling position (Step S23), and determines whether the bundle of banknotes P1 is normally made (Step S24).

If the bundle of banknotes P1 is normally made (Yes at Step S24), the control unit 180 stores the bundle ID 204 of the bundle P1 and the serial numbers of the one-hundred banknotes of the bundle P1 in an associated form in the banknote-bundle managing unit 160 (Step S25), and ends the processes shown in FIG. 9.

If the number of the bundling-object-banknotes P stacked in the bundling-side stacking unit 21 has not reached one hundred at Step S20 (No at Step S20), the system control proceeds to Step S11 to acquire the banknote-kind of the next banknote being transported.

In case when the banknote is not being transported normally at Step S12, that is, there is a transport error, when the denomination recognition of the banknote is not performed normally, that is, there is a denomination recognition error (No at Step S12), when the banknote is decided to be a not genuine banknote at Step S14, that is, the banknote is counterfeit (No at Step S14), or when the serial number of the banknote cannot be identified at Step S16 (No at Step S16), the control unit 180 causes the banknote to be transported to the first reject unit 18B (Step S26) and then ends the processes shown in FIG. 9.

If the denomination of the banknote is not the specific denomination of the bundling-object-banknotes P at Step S13 (No at Step S13), the control unit 180 determines whether there is a stacker 17 or a first reject unit 18A corresponding to the denomination of the banknote (Step S27A). If there is a stacker 17 corresponding to the denomination of the banknote (Yes at Step S27A), the control unit 180 causes the banknote to be transported to the stacker 17 corresponding to the denomination of the banknote (Step S27) and the process control proceeds to Step M1 to end the processes shown in FIG. 9.

When it is decided at Step S15 that the banknote is not a fit note, that is, the banknote is an unfit note (No at Step S15), the control unit 180 determines whether there is a stacker 17 or a first reject unit 18A corresponding to unfit banknotes of the same denomination as that of the banknote (Step S28A). If there is a stacker 17 or a first reject unit 18A corresponding to unfit banknotes of the same denomination (Yes at Step S28A), the control unit 180 causes the banknote to be transported to the stacker 17, the first reject unit 18A, or the second reject unit 190 corresponding to unfit banknotes of the same denomination (Step S28), and the system control proceeds to Step M1 to end the processes shown in FIG. 9.

If the bundle of banknotes P1 is not formed normally (No at Step S24), the control unit 180 deletes the serial numbers of the one-hundred banknotes of the bundle of banknotes P1 stored in the temporary storage unit 182 (Step S29) and ends the processes shown in FIG. 9.

When there is no stacker 17 corresponding to the denomination of the banknote (No at Step S27A), the system control proceeds to Step M2 shown in FIG. 9 to transport the banknote to the first reject unit 18B.

If there is no stacker 17 or first reject unit 18A corresponding to the unfit banknotes of the same denomination (No at Step S28A), the system control proceeds to Step M3 shown FIG. 9 to transport the banknote to the first reject unit 18B.

If the number of the bundling-object-banknotes P stacked in the bundling-side stacking unit 21 reaches one hundred in the banknote bundling process explained with reference to FIG. 9, the banknote sorting and bundling apparatus 1 creates the bundle ID 204 for distinguishing the one-hundred bundling-object-banknotes P, that is, the bundle of banknotes P1, and prints the bundle ID 204 on the bundling tape R and stores the serial numbers of all the banknotes of the bundle of banknotes P1 in an associated form with the bundle ID 204 in the banknote-bundle managing unit 160.

A financial institution, for example, the bundle of banknotes P1 made by the banknote bundling process shown in FIG. 9 is dispensed to a customer in response to a withdrawal request from the customer.

After that, if a customer makes a false claim, regarding the bundle of banknotes P1 dispensed by the financial institution, such as that the bundle of banknotes P1 includes counterfeit notes, or that the number of banknotes is falling short of the desired number, etc., customer is requested to submit to the final institution the bundle ID 204 printed on the bundling tape R of the bundle of banknotes P1. When the customer submits the bundle ID 204, it is inputted by using the operation unit 140.

Upon detecting the input of the bundle ID 204, the control unit 180 reads out the serial numbers 160B of all the banknotes of the bundle P1 corresponding to the inputted bundle ID 204 from the banknote-bundle managing unit 160 and displays the serial numbers 160B of all the banknotes of the bundle P1 on the display device 4.

Thus, the operator of the financial institution can view the serial numbers 160B of all the banknotes of the valid bundle of banknotes P1 dispensed by the financial institution on the display device 4 and can compare the serial numbers 160B with those on the banknotes of the bundle of the customer. Thus, the operator can handle the false claim based on the comparison result.

In the present embodiment, the banknote sorting and bundling apparatus 1 acquires the serial numbers of all the banknotes of the bundle of banknotes P1, creates the bundle ID 204, for each of the bundle P1, associated with the serial numbers of all the banknotes of the bundle P1, and prints the bundle ID 204 of each bundle P1 on the bundling tape R of the bundle P1. Consequently, even if a false claim is made against the valid bundle of banknotes P1 dispensed by the financial institution, the operator can obtain the serial numbers 160B of all the banknotes of the bundle of banknotes P1 in an associated form with the bundle ID 204 printed on the bundling tape R, and can adequately handle the false claim and protect the credibility of the financial institution by comparison and checking process based on the serial numbers 160B.

In the present embodiment, the banknote sorting and bundling apparatus 1 stores therein and manages the serial numbers 160B of all the banknotes of the bundle of banknotes P1 in an associated form with the bundle ID 204 of the bundle of banknotes P1 in the banknote-bundle managing unit 160. Consequently, the financial institution can obtain the serial numbers 160B of all the banknotes of the valid bundle of banknotes P1 dispensed by itself and thus can adequately handle the false claim.

In the present embodiment, the banknote sorting and bundling apparatus 1 searches, in response to an input of the bundle ID 204 printed on the bundling tape R as a search target, the banknote-bundle managing unit 160 for the serial numbers 160B of all the banknotes of the bundle of banknotes P1 associated with the bundle ID 204 corresponding to the inputted bundle ID 204, and displays the serial numbers 160B of all the banknotes of the bundle of banknotes P1 as a search result on the display device 4. Consequently, even if a false claim is made by a customer regarding the valid bundle of banknotes P1 dispensed by the financial institution, by requesting the customer to submit the bundle ID 204 printed on the bundling tape R and inputting the bundle ID 204, the serial numbers 160B of all the banknotes of the bundle of banknotes P1 dispensed by the financial institution can be displayed on the display screen, and thus the false claim can be adequately handled.

In the above embodiment, the bundle ID 204 for distinguishing the bundle of banknotes P1 is printed on the bundling tape R of the bundle of banknotes P1, and when searching for a bundle of banknotes P1, the bundle ID of the target bundle of banknotes P1 is inputted to display the serial numbers 160B of all the banknotes of the bundle of banknotes P1 corresponding to the bundle ID 204 on the display device 4. However, the same advantages can be obtained if a barcode corresponding to the bundle ID 204 is printed on the bundling tape R, and when searching for a bundle of banknotes P1, the barcode corresponding to the target bundle ID 204 is read to display the serial numbers of all the banknotes of the bundle of banknotes P1 corresponding to the bundle ID 204 represented by the barcode on the display device 4. In this case, because the barcode only needs to be read, a work burden for inputting the target bundle ID 204 is reduced.

In the above embodiment, the bundle ID 204 for distinguishing the bundle of banknotes P1 is printed on the bundling tape R of the bundle of banknotes P1. However, an IC chip containing the serial numbers of all the banknotes of the bundle of banknotes P1 can be affixed to the bundling tape R of the bundle of banknotes P1, and when searching for a bundle of banknotes P1, the IC chip affixed to the bundling tape can be read and the serial numbers of all the banknotes of the bundle of banknotes P1 contained in the IC chip can be displayed on the display device 4. In this case, even if a false claim is made regarding the valid bundle of banknotes P1 dispensed by the financial institution, by requesting the user to submit the IC chip affixed to the bundling tape R, and reading the IC chip, the serial numbers of all the banknotes of the bundle of banknotes P1 dispensed by the financial institution can be displayed on the display screen, and thus the false claim can be adequately handled.

Furthermore, the work burden for inputting the target bundle ID 204 can be reduced, and, moreover, the serial numbers of all the banknotes of the bundle of banknotes P1 need not be stored in the banknote-bundle managing unit 160. Although in this case it is supposed that the serial numbers of all the banknotes of the bundle of banknotes P1 need not be stored in the banknote-bundle managing unit 160, the same advantages can be obtained even if the serial numbers of all the banknotes of the bundle of banknotes P1 are stored in the banknote-bundle managing unit 160 as described in the above embodiment.

In the above embodiment, the bundle ID 204 for distinguishing the bundle of banknotes P1 is printed on the bundling tape R of the bundle of banknotes P1. However, the same advantages can be obtained even if the serial numbers of all the banknotes of the bundle of banknotes P1 are printed, on the bundling tape R, instead of printing only the bundle ID 204.

In the above embodiment, the serial numbers of all the banknotes of the bundle of banknotes P1 corresponding to the bundle ID 204 are displayed on the display device 4 when the target bundle ID 204 is inputted. However, the same advantages can be obtained even if the serial numbers is printed out by a not shown printer device.

In the above embodiment, the serial numbers of all the banknotes of the bundle of banknotes P1 acquired through the serial-number identification unit 16 are stored and managed in an associated form with the bundle ID 204 in the banknote-bundle managing unit 160. However, an image of at least one face out of a front face and a back face of the banknote can be acquired, and instead of storing the serial numbers, the acquired images for all the banknotes of the bundle of banknotes P1 can be stored in an associated form with the bundle ID 204 in the banknote-bundle managing unit 160. In this case, even if a false claim is made by a customer regarding the valid bundle of banknotes P1 dispensed by the financial institution, by requesting the customer to submit the bundle ID 204 printed on the bundling tape R, and inputting the bundle ID 204, the banknote images of all the banknotes of the bundle of banknotes P1 dispensed by the financial institution can be displayed on the display screen, and thus the false claim can be adequately handled. Furthermore, in this case, a more accurate comparison can be realized by using the banknote image as compared to the serial number.

In the above embodiment, the serial numbers 160B of all the banknotes of the bundle of banknotes P1 corresponding to the bundle ID 204 of the bundle of banknotes P1 are stored and managed in the banknote-bundle managing unit 160 and the serial numbers 160B of all the banknotes of the bundle of banknotes P1 corresponding to the bundle ID 204 are displayed on the display device 4 in response to the input of the bundle ID 204 as search target. However, the financial institution can install the banknote-bundle managing unit 160 at a center that controls its branches, and display the serial numbers of all the banknotes of the bundle of banknotes P1 corresponding to the bundle ID 204 on the display screen of a branch terminal at a remote location in response to an information inquiry access for the target bundle ID 204 from the branch terminal. In this case, the financial institution can adequately handle a false claim regarding the bundle of banknotes dispensed by itself even from a remote location.

In the above embodiment, when the bundle of banknotes P1 is formed by deposited banknotes by a depositor, the bundle ID 204 of the bundle of banknotes P1, the depositor names and the serial numbers of all the banknotes of the bundle of banknotes P1 can be stored and managed in an associated form in the banknote-bundle managing unit 160. That is, the depositor information is associated with the serial numbers of the deposited banknotes. In this case, all the banknotes are managed from the time of deposit to the time of dispensing.

In the above embodiment, the banknote sorting and bundling apparatus 1 including the banknote processing device 2 and the banknote bundling device 3 stores and manages the serial numbers, identified by the serial-number-identification unit 16, of all the banknotes of the bundle of banknotes P1 and the bundle ID 204 in an associated form in the banknote-bundle managing unit 160. However, the serial-number identification unit 16, the bundle-ID creating unit 183, and the banknote-bundle managing unit 160 can be built in an information processing apparatus, such as a personal computer, which can be connected to the banknote sorting and bundling apparatus. With this configuration, in the information processing apparatus, the serial numbers of all the banknotes of the bundle of banknotes P1 can be identified by the serial-number identification unit 16, the bundle ID 204 for distinguishing the bundle of banknotes P1 can be created by the bundle-ID creating unit 183, and the serial numbers of all the banknotes in the bundle of banknotes P1 and the bundle ID 204 can be stored and managed in an associated form in the banknote-bundle managing unit 160. Thus, in this case, the processing load of the banknote sorting and bundling apparatus 1 for performing a serial-number identification process, a bundle ID creation process, and a serial number storage process can be greatly reduced.

In the above embodiment, among the three bundling-side stacking units 21, one bundling-side stacking unit 21 is set as spare and the remaining two bundling-side stacking units 21 are set for stacking banknotes of different denominations. However, the same advantages can be realized even if the remaining two bundling-side stacking units 21 are set for stacking banknotes of the same denomination.

In the above embodiment, genuine and fit banknotes of specific denominations, such as, genuine and fit banknotes of 10 USD and 20 USD banknotes are set as the bundling-object-banknotes P. However, the bundling-object-banknotes P can be set to any kind of banknotes, such as genuine and unfit banknotes of specific denominations.

In the above embodiment, when the number of the bundling-object-banknotes P stacked in the bundling-side stacking unit 21 reaches one hundred, the transport unit 42 of the pre-bundling transport unit 25 draws out the bundling-object-banknotes P and transports them onto the bundling stage 22A inside the bundling unit 22. However, the same advantages can be realized even when the transport unit 42 transports the drawn out bundling-object-banknotes P to near an entrance of the bundling unit 22, the holding unit 27A of the hold and transport unit 27 holds the short-edge of the bundling-object-banknotes P near the entrance of the bundling unit 22 and transports them to the operation preparation position on the bundling stage 22A.

In the above embodiment, the banknote sorting and bundling apparatus 1 including the banknote bundling device 3 and the banknote processing device 2 is explained as an example. However, the same advantages can be realized even if the banknote sorting and bundling apparatus 1 includes only the banknote bundling device 3.

In the above embodiment, the banknote bundling device 3 that bundles the bundling-object-banknotes P with the bundling tape R is explained as an example. However, the same advantages can be realized even when paper sheets such as gift coupons and valuable securities are bundled with the bundling tape R.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth. The advantages of the present embodiment are not limited to those stated here.

All the automatic processes explained in the present embodiment can be, entirely or in part, carried out manually by a known method. Similarly, all the manual processes explained in the present embodiment can be, entirely or in part, carried out automatically by a known method. The process procedures, the control procedures, specific names, and data, including various parameters, mentioned in the description and drawings can be changed as required unless otherwise specified.

The constituent elements of the apparatus illustrated are merely conceptual and may not necessarily physically resemble the structures shown in the drawings. For example, the apparatus need not necessarily have the structure that is illustrated. The apparatus as a whole or in parts can be broken down or integrated either functionally or physically in accordance with the load or how the device is to be used.

Each processing function performed by the apparatus can be entirely or partially performed by a CPU (Central Processing Unit) (or a microcomputer such as an MPU (Micro Processing Unit),) and an MCU (Micro Controller Unit)), or a computer program executed by the CPU (or the microcomputer such as the MPU, and the MCU), or a hardware using wired logic.

INDUSTRIAL APPLICABILITY

The banknote bundling device according to the present invention acquires banknote-specific information for each banknote in a bundle of banknotes, creates related information, for each bundle of banknotes, associated with the banknote-specific information for each banknote in the bundle of banknotes, and further assigns the related information to a bundling tape of the bundle of banknotes for each bundle of banknotes. Because the banknote-specific information of each banknote in a bundle of banknotes is associated with the related information assigned to the bundling tape, the user of the banknote bundling device, such as a financial institution, can obtain the banknote-specific information of each banknote in a bundle of banknotes, and thus can adequately defend itself against a false claim regarding a valid bundle of banknotes, and protect its own credibility. Therefore, the banknote bundling device is useful in, for example, the banknote sorting and bundling apparatus used by financial institutions.

The invention claimed is:

1. A banknote bundling device that makes a bundle of banknotes by bundling with a bundling tape a plurality of bundling-object-banknotes, the banknote bundling device comprising:

a specific information acquiring unit that acquires, for each banknote, banknote-specific information for distinguishing the banknote;

a related information creating unit that creates, for each bundle of banknotes, related information used for managing all of the banknote-specific information of each banknote of the bundle of banknotes;

a related information assigning unit that assigns, for each bundle of banknotes, the related information created by the related information creating unit to the bundling tape of the bundle of banknotes; and an information storage managing unit that stores therein and manages all of the banknote-specific information of each banknote of the bundle of banknotes in an associated form with the related information of the bundle of banknotes;

wherein the related information is bundle identification information for distinguishing the bundle of banknotes.

2. The banknote bundling device according to claim 1, further comprising:

an information searching unit that, in response to an input operation for inputting the related information assigned to the bundling tape, searches the information storage managing unit for the banknote-specific information of each banknote of the bundle of banknotes associated with the related information inputted in the input operation; and an information output unit that outputs the banknote-specific information of each banknote of the bundle of banknotes that is a search result by the information searching unit.

3. The banknote bundling device according to claim 1, further comprising:

an information searching unit that, in response to a reading operation for reading the related information assigned to the bundling tape, searches the information storage managing unit for the banknote-specific information of each banknote of the bundle of banknotes associated with the related information read by the reading operation; and an information output unit that outputs the banknote-specific information for each banknote of the bundle of banknotes that is a search result by the information searching unit.

4. The banknote bundling device according to claim 1, wherein the banknote-specific information is serial number information that is printed on the banknote.

5. The banknote bundling device according to claim 1, wherein the banknote-specific information is an image of at least one face out of a front face and a back face of the banknote.

6. The banknote bundling device according to claim 1, wherein the bundling-object-banknotes are genuine notes of a specific denomination.

7. The banknote bundling device according to claim 1, wherein the related information assigning unit prints the related information on the bundling tape of the bundle of banknotes.

8. A banknote bundling method for making a bundle of banknotes by bundling with a bundling tape a plurality of bundling-object-banknotes, the banknote bundling method comprising:

acquiring, for each banknote, banknote-specific information for distinguishing the banknote;

creating, for each bundle of banknotes, related information used for managing all of the banknote-specific information of each banknote of the bundle of banknotes;

assigning, for each bundle of banknotes, the related information created at the creating to the bundling tape of the bundle of banknotes; and storing and managing all of the banknote-specific information of each banknote of the bundle of banknotes in an associated form with the related information of the bundle of banknotes in an information storage managing unit, wherein the related information is bundle identification information for distinguishing the bundle of banknotes.

9. The banknote bundling method according to claim 8, further comprising:

searching, in response to an input operation for inputting the related information assigned to the bundling tape, the information storage managing unit for the banknote-specific information of each banknote of the bundle of banknotes associated with the related information inputted in the input operation; and outputting the banknote-specific information of each banknote of the bundle of banknotes that is a search result at the searching.

10. A banknote bundling system comprising:

a banknote bundling device that makes a bundle of banknotes by bundling with a bundling tape a plurality of bundling-object-banknotes; and an information managing device that manages information associated with the bundle of banknotes, wherein the information managing device includes a specific information acquiring unit that acquires, for each banknote, banknote-specific information for distinguishing the banknote;

a related information creating unit that creates, for each bundle of banknotes, related information to be associated with the banknote-specific information of each banknote of the bundle of banknotes; and an information storage managing unit that stores therein and manages all of the banknote-specific information of each banknote of the bundle of banknotes in an associated form with the related information of the bundle of banknotes, and the banknote bundling device includes a related information assigning unit that assigns, for each bundle of banknotes, the related information created by the related information creating unit to the bundling tape of the bundle of banknotes, and wherein the related information is bundle identification information for distinguishing the bundle of banknotes.

11. The banknote bundling system according to claim 10, wherein the information managing device further includes:

an information searching unit that, upon detecting an inquiry regarding the related information assigned to the bundling tape from a terminal device that is connected to the information managing device, searches the information storage managing unit for the banknote-specific information of each banknote of the bundle of banknotes associated with the related information; and an information output unit that outputs to the terminal device the banknote-specific information of each banknote of the bundle of banknotes that is a search result by the information searching unit.

12. A banknote bundling device that makes a bundle of banknotes by bundling with a bundling tape a plurality of bundling-object-banknotes, the banknote bundling device comprising:

a specific information acquiring unit that acquires, for each banknote, banknote-specific information for distinguishing the banknote;

a bundle-ID creating unit that creates, for each bundle of banknotes, a bundle ID for distinguishing the bundle of banknotes;

a bundle-ID assigning unit that assigns, for each bundle of banknotes, the bundle ID created by the bundle-ID creating unit to the bundling tape of the bundle of banknotes; and an information storage managing unit that stores therein and manages all of the banknote-specific information of each banknote of the bundle of banknotes in an associated form with the bundle ID of the bundle of banknotes.

* * * * *